US007654846B2

(12) United States Patent
Kimura et al.

(10) Patent No.: US 7,654,846 B2
(45) Date of Patent: Feb. 2, 2010

(54) CONNECTOR FOR ELECTRICALLY CONNECTING CIRCUIT BOARDS

(75) Inventors: Masaki Kimura, Tokyo (JP); Nobukazu Kato, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/397,533

(22) Filed: Mar. 4, 2009

(65) Prior Publication Data

US 2009/0227146 A1 Sep. 10, 2009

(30) Foreign Application Priority Data

Mar. 5, 2008 (JP) ..... 2008-055328

(51) Int. Cl.
*H01R 13/62* (2006.01)

(52) U.S. Cl. ..... 439/326; 439/631; 439/637

(58) Field of Classification Search ..... 439/326, 439/631, 636, 637
See application file for complete search history.

(56) References Cited

U.S. PATENT DOCUMENTS 3,366,919 A * 1/1968 Gammel, Sr. et al. ..... 439/495
5,470,246 A * 11/1995 Mosquera ..... 439/260
5,836,780 A * 11/1998 Mizumura et al. ..... 439/326

FOREIGN PATENT DOCUMENTS

JP 9-306606 A 11/1997

* cited by examiner

*Primary Examiner*—Neil Abrams
(74) *Attorney, Agent, or Firm*—Frishauf, Holtz, Goodman & Chick, P.C.

(57) ABSTRACT

A connector capable of electrically connecting two plate-shaped to-be-connected objects in a state arranged on substantially the same plane. Upper contacts are inserted into a housing from rearward, and held thereby. Lower contacts are inserted into the housing from forward, and held thereby. A contact portion of each upper contact is located on a front side of the housing, for contact with an upper surface of a circuit card inserted into a receiving space of the housing. A terminal portion of the upper contact is located on a rear side of the housing, for connection to a motherboard. A contact portion of each lower contact is located on the front side of the housing, for contact with a lower surface of the circuit card inserted into the receiving space of the housing. A terminal portion of the lower contact is located on the rear side of the housing, for connection to the motherboard.

8 Claims, 31 Drawing Sheets

CONNECTOR FOR ELECTRICALLY CONNECTING CIRCUIT BOARDS

BACKGROUND OF THE INVENTION

1. Field of the Invention

This invention relates to a connector, and more particularly to a connector for electrically connecting plate-shaped to-be-connected objects.

2. Description of the Related Art

Conventionally, a connector for electrically connecting plate-shaped to-be-connected objects has been disclosed in Japanese Laid-Open Patent Publication (Kokai) No. H09-306606.

This connector includes a housing that has a receiving space for receiving a card, which is one of the to-be-connected objects, and a plurality of contacts arranged in two rows, i.e. upper and lower rows, in the housing.

A plurality of upper contacts that form the upper row are press-fitted into the housing from a rear side of the housing, and a plurality of lower contacts that form the lower row are press-fitted into the housing from a front side of the housing.

Contact portions of the upper contacts are located toward the front of the housing, and terminal portions of the same are located toward the rear of the housing.

Contact portions and terminal portions of the lower contacts are located toward the front of the housing.

To connect the to-be-connected objects by the above-described connector, the whole connector has to be placed on a circuit board, which is the other to-be-connected object, due to the structure of the connector. As a result, the card and the circuit board are connected in parallel in a state separated from each other in the direction of the height of the connector by the thickness of a (lower) portion of the housing, for holding the lower contacts.

As described above, since the card and the circuit board are separated from each other by the thickness of the portion of the housing, for holding the lower contacts of the connector, it is required to provide a space (space in the direction of the height of the connector) large enough to accommodate the card and the circuit board in a casing e.g. of a notebook PC (Personal Computer).

SUMMARY OF THE INVENTION

The present invention has been made in view of these circumstances, and an object thereof is to provide a connector which is capable of electrically connecting two plate-shaped to-be-connected objects in a state arranged on substantially the same plane.

To attain the above object, in a first aspect of the present invention, there is provided a connector for electrically connecting one plate-shaped to-be-connected object and another plate-shaped to-be-connected object, comprising a housing that has a receiving space for receiving one end of the one to-be-connected object, and is fixed to one or the other surface of one end of the other to-be-connected object, and a plurality of contacts that are arranged in upper and lower rows in the housing, wherein out of the plurality of contacts, a plurality of upper contacts that form the upper row are inserted into the housing from rearward of the housing, for being held by the housing, wherein out of the plurality of contacts, a plurality of lower contacts that form the lower row are inserted into the housing from forward of the housing, for being held by the housing, wherein the upper contacts each comprise an upper contact portion that is located on a front side of the housing, for being brought into contact with an upper surface of the one end of the one to-be-connected object inserted into the receiving space, an upper connecting portion that is located on a rear side of the housing, for being connected to the one end of the other to-be-connected object, and an upper connecting portion that connects between the upper contact portion and the upper connecting portion, wherein the lower contacts each comprise a lower contact portion that is located on the front side of the housing, for being brought into contact with a lower surface of the one end of the one to-be-connected object inserted into the receiving space, a lower connecting portion that is located on the rear side of the housing, for being connected to the one end of the other to-be-connected object, and a lower connecting portion that connects between the lower contact portion and the lower connecting portion, and wherein the receiving space is located on an imaginary extended plane of one or the other surface of the one end of the other to-be-connected object.

With the arrangement of this connector, each upper contact has the upper connecting portion located on the rear side of the housing, and is connected to the other to-be-connected object, while each lower contact have the lower connecting portion located on the rear side of the housing, and is connected to the other to-be-connected object, so that it is possible to dispose the receiving space on a side of the other to-be-connected object. This makes it possible to electrically connect the two plate-shaped to-be-connected objects in the state arranged on substantially the same plane.

Preferably, part of the lower connecting portion extends from the front side to the rear side of the housing along a bottom surface of the housing.

More preferably, a plurality of ribs extending from the front side to the rear side of the housing are formed on the bottom surface of the housing, and part of the lower connecting portion is received between associated ones of the ribs.

Preferably, the upper connecting portion is pin-shaped such that the upper connecting portion can be inserted into a through hole of the other to-be-connected object, and the lower connecting portion has a planar shape that can be surface-mounted on the other to-be-connected object.

Preferably, the upper connecting portion has a planar shape that can be surface-mounted on the other to-be-connected object, and the lower connecting portion is pin-shaped such that the lower connecting portion can be inserted into a through hole of the other to-be-connected object.

Preferably, the upper connecting portion includes a first contact portion that can be brought into contact with one surface of the other to-be-connected object, and a first spring portion that urges the first contact portion against the other to-be-connected object, and the lower connecting portion includes a second contact portion that can be brought into contact with the other surface of the other to-be-connected object, and a second spring portion that urges the second contact portion against the other to-be-connected object.

Preferably, the housing is formed with a first rotation-preventing surface that is brought into contact with one or the other surface of the other to-be-connected object, and transmits a rotational force of the housing, which is generated when the one end of the one to-be-connected object is obliquely inserted into the receiving space of the housing and the one to-be-connected object is caused to become substantially parallel to the other to-be-connected object, to the one or the other surface of the other to-be-connected object, to thereby prevent rotation of the housing.

Preferably, the housing is formed with a second rotation-preventing surface that is brought into contact with a fixing member fixed to the other to-be-connected object, and transmits a rotational force of the housing, which is generated when the one end of the one to-be-connected object is obliquely inserted into the receiving space of the housing and the one to-be-connected object is caused to become substantially parallel to the other to-be-connected object, to the fixing member, to thereby prevent rotation of the housing.

According to the present invention, it is possible to electrically connect the two plate-shaped to-be-connected objects in the state arranged on substantially the same plane, and reduce a space in a vertical direction of the connector, necessary for connecting the two plate-shaped to-be-connected objects.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Referring to FIGS. 1A to 1C and FIGS. 2 to 6, the connector 1 is comprised of a housing 3, contacts 5, rotation stop members (fixing members) 7, and a locator 9. The connector 1 is for electrically connecting between a circuit card (one plate-shaped to-be-connected object) 21, described hereinafter, and a motherboard (another plate-shaped to-be-connected object) 22, described hereinafter.

Figure 19A:
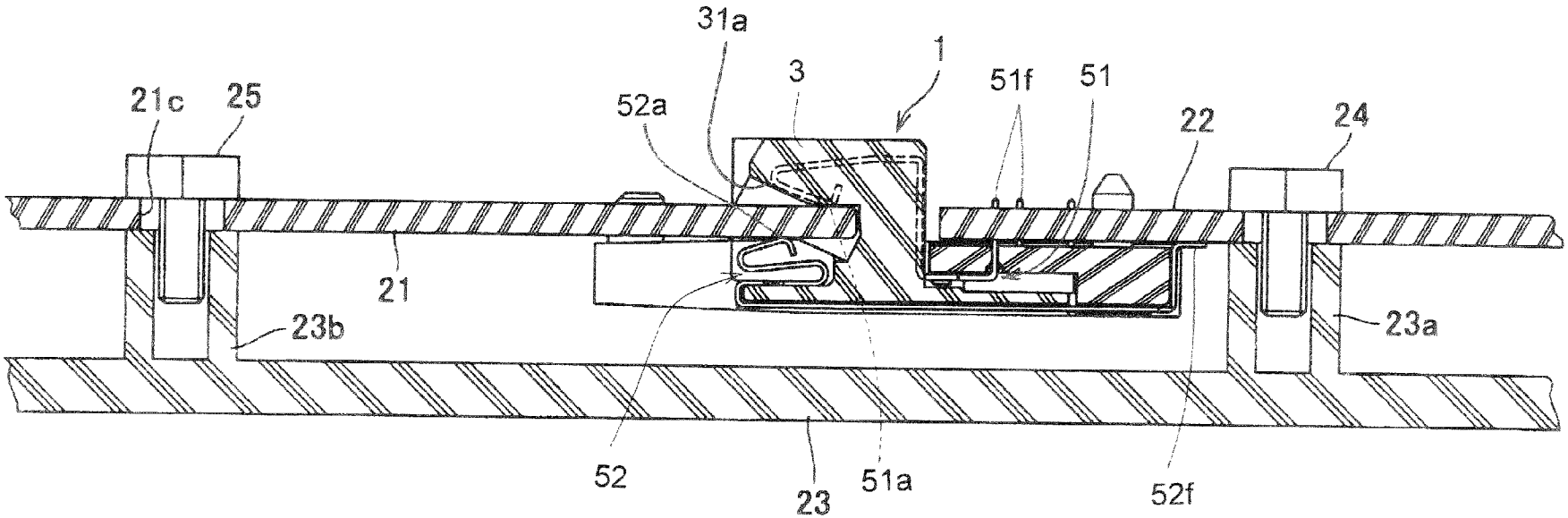
FIG. 19A is a cross-sectional view of a mounted state of the FIG. 18A connector, motherboard, and circuit card.

As shown in FIGS. 7 to 12, the housing 3 is formed of an insulating material, and is comprised of a housing body 31, a locator-disposing portion 32, and flange portions 33. The housing body 31 is generally prism-shaped. The housing body 31 is formed with a receiving space 31*a*. Referring to FIG. 19A, when the connector 1 is mounted on the motherboard 22, the receiving space 31*a* is generally positioned on an imaginary extended plane F (see FIG. 7) of a lower surface (the other surface) of the motherboard 22. The receiving space 31*a* receives a foremost end (one end) of the circuit card 21, described hereinafter. The foremost end of the circuit card 21 is supported by the housing body 31 such that it can be rotated through a predetermined angle about a contact portion brought into contact with the housing body 31. The housing body 31 has an upper part of a rear-side portion having a plurality of upper contact-inserting portions 31*b* (see FIG. 8) formed at equally-spaced intervals in the direction of the length of the housing body 31. The upper contact-inserting portions 31*b* communicate with the receiving space 31*a*. Further, the upper contact-inserting portions 31*b* communicate with a space rearward of the housing body 31. The housing body 31 has a lower part of a front-side portion having a plurality of lower contact-inserting portions 31*c* (see FIG. 7) formed at equally-spaced intervals in the direction of the length of the housing body 31. The lower contact-inserting portions 31*c* communicate with the receiving space 31*a*. Further, the lower contact-inserting portions 31*c* communicate with a space forward of the housing body 31. The housing body 31 has a lower part of the rear-side portion having a plurality of holes 31*d* (see FIG. 8) formed at equally-spaced intervals in the direction of the length of the housing body 31. The holes 31*d* communicate with the receiving space 31*a*, and communicate with the space rearward of the housing 31. The holes 31*d* are located under the upper contact-inserting portions 31*b*. When the receiving space 31*a* is formed by using a mold, the holes 31*d* are inevitably formed due to the structure of the mold. Further, in the connector according to the present embodiment, the plurality of upper contact-inserting portions 31*b* are formed in the upper part of the rear-side portion of the housing body 31, and the plurality of lower contact-inserting portions 31*c* are formed in the lower part of the front-side portion of the housing body 31. The reason why the lower contact-inserting portions 31*c* are formed in the lower part of the front-side portion of the housing body 31 is to avoid connection between the holes 31*d* that are inevitably formed in forming the receiving space 31*a* by using a mold, and the lower contact-inserting portions 31*c*.

The locator-disposing portion 32 is substantially plate-shaped, and is continuous with or coupled to the lower part of the rear-side portion of the housing body 31. The locator 9 is disposed in the locator-disposing portion 32.

Figure 9:
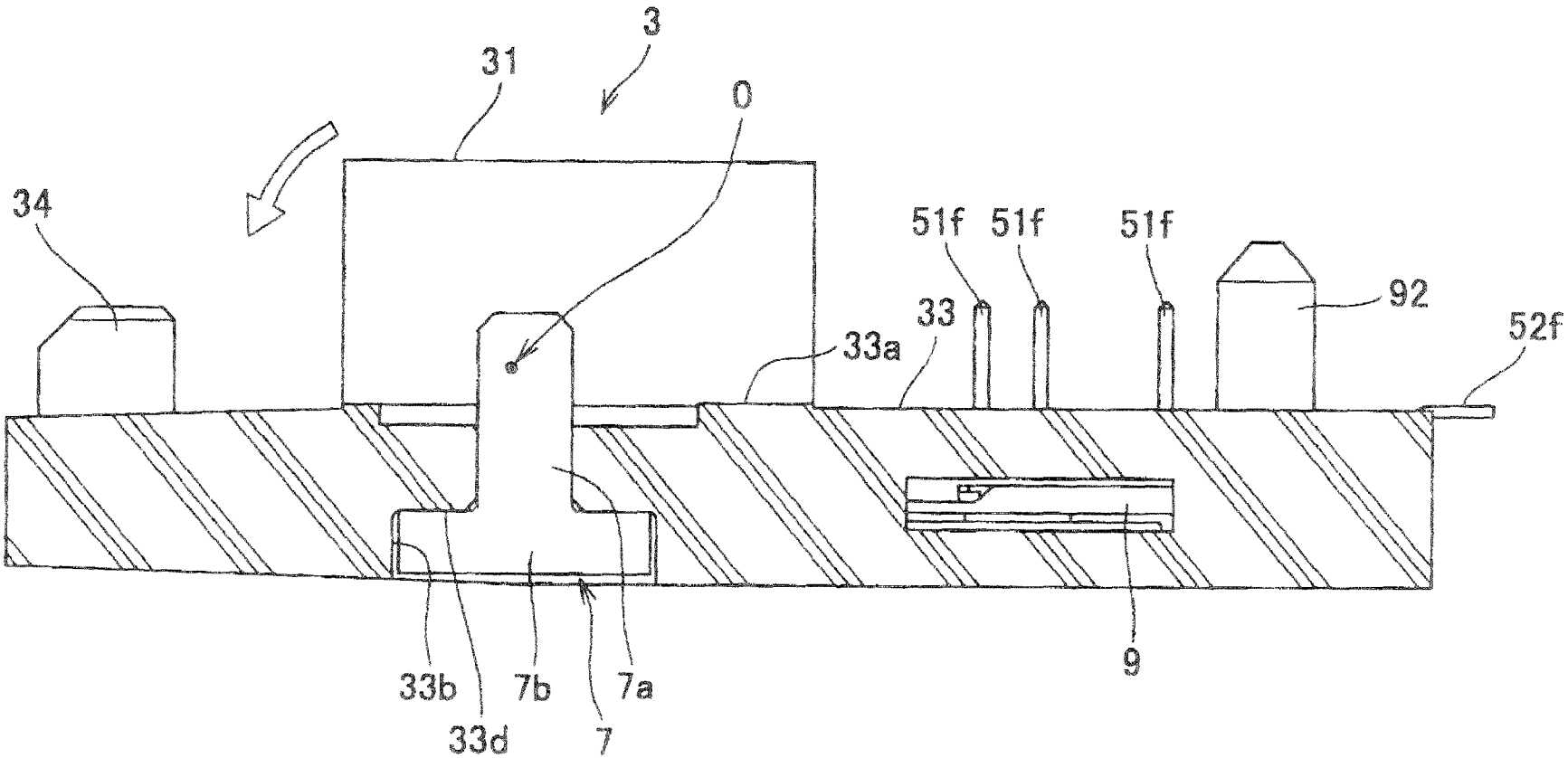
FIG. 9 is a cross-sectional view taken on line IX-IX of FIG. 1A.
Figure 10:
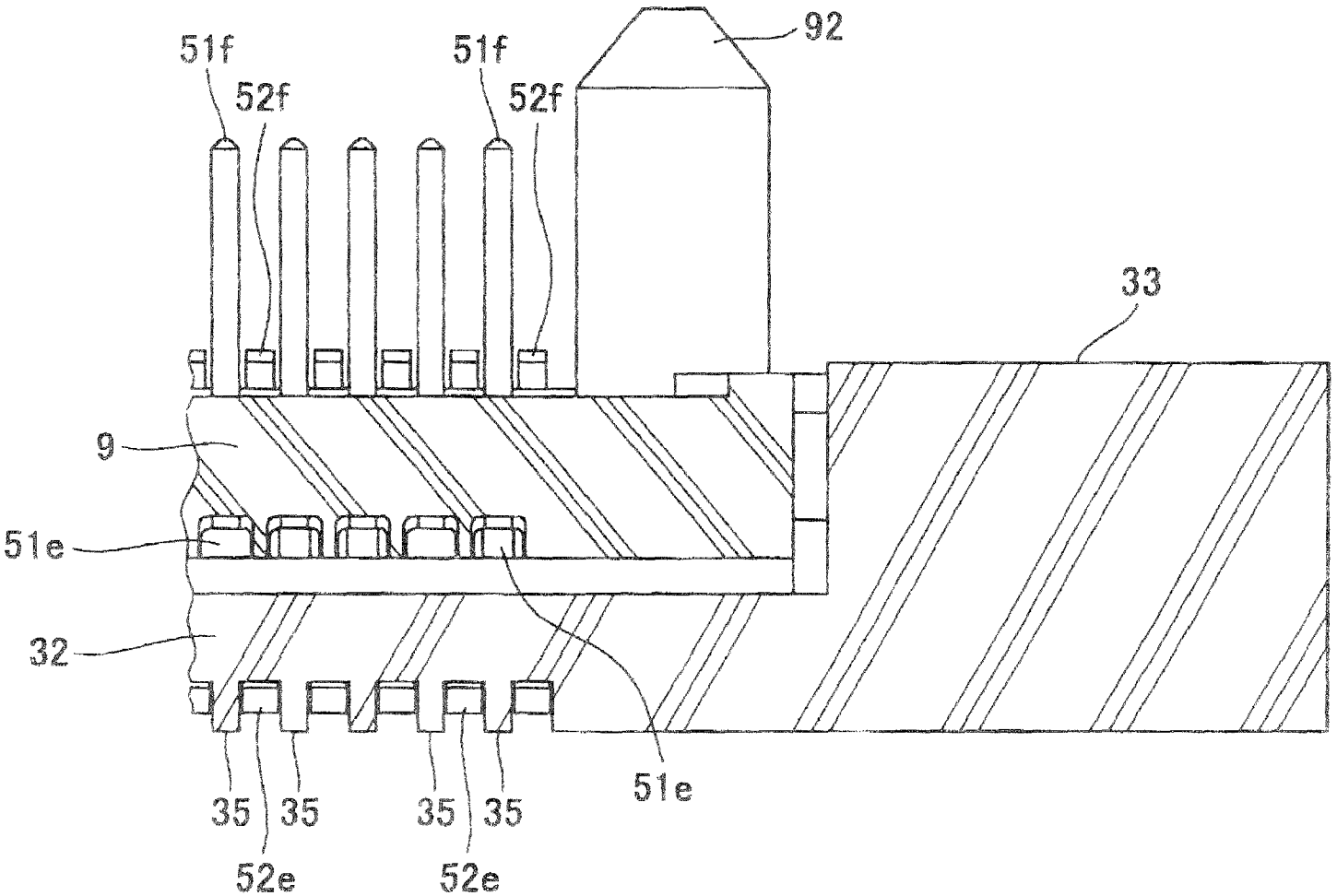
FIG. 10 is a cross-sectional view taken on line X-X of FIG. 1B.

The flange portions 33 are coupled to the opposite sides of the housing body 31 and the locator-disposing portion 32. As shown in FIG. 9, a convex surface (first rotation-preventing surface) 33*a* is formed on an upper surface of a central part of the flange portion 33 located at a location rearward of a rotation center O. The convex surface 33*a* is brought into contact with a lower surface of the motherboard 22 when the connector 1 is mounted on a front edge of the motherboard 22. The flange portion 33 has a central portion formed with an accommodating space 33*b*. A substantially T-shaped rotation stop member 7 is inserted into the accommodating space 33*b*. The flange portion 33 has a positioning boss 34 formed on an upper surface of a front portion thereof. Further, the flange portion 33 has a recess 33*c* formed in an inner side surface of a rear portion thereof, for use in mounting the locator 9 (see FIGS. 3, 11, and 12). When the positioning bosses 34 of the flange portions 33 are inserted into positioning holes 21*b* (see FIG. 15) of the circuit card 21, respectively, the circuit card 21 is positioned, whereby it is prevented from being pulled out. Further, an abutting surface (second rotation-preventing surface) 33*d* is formed on an inner surface of the accommodating space 33*b* of the flange portion 33, for transmitting the rotational force of the housing 3 to a retaining portion 7*b*, referred to hereinafter, of the rotation stop member 7, which makes it possible to prevent the rotation of the housing 3 even when the housing 3 is about to rotate during insertion of the circuit card 21.

It should be noted that a surface of each flange portion 33, opposed to a mounting surface of the motherboard 22, is located between an upper surface and a lower surface of the housing body 31. The flange portions 33 have a function of making it possible to mount the housing 3 on an edge of the motherboard 22.

The housing body 31 and the locator-disposing portion 32 have respective bottom surfaces having a plurality of ribs 35 formed at equally-spaced intervals in a direction of the arrangement of contacts (see FIGS. 7 and 10) The ribs 35 extend in a front-rear direction of the housing 3.

Figure 11:
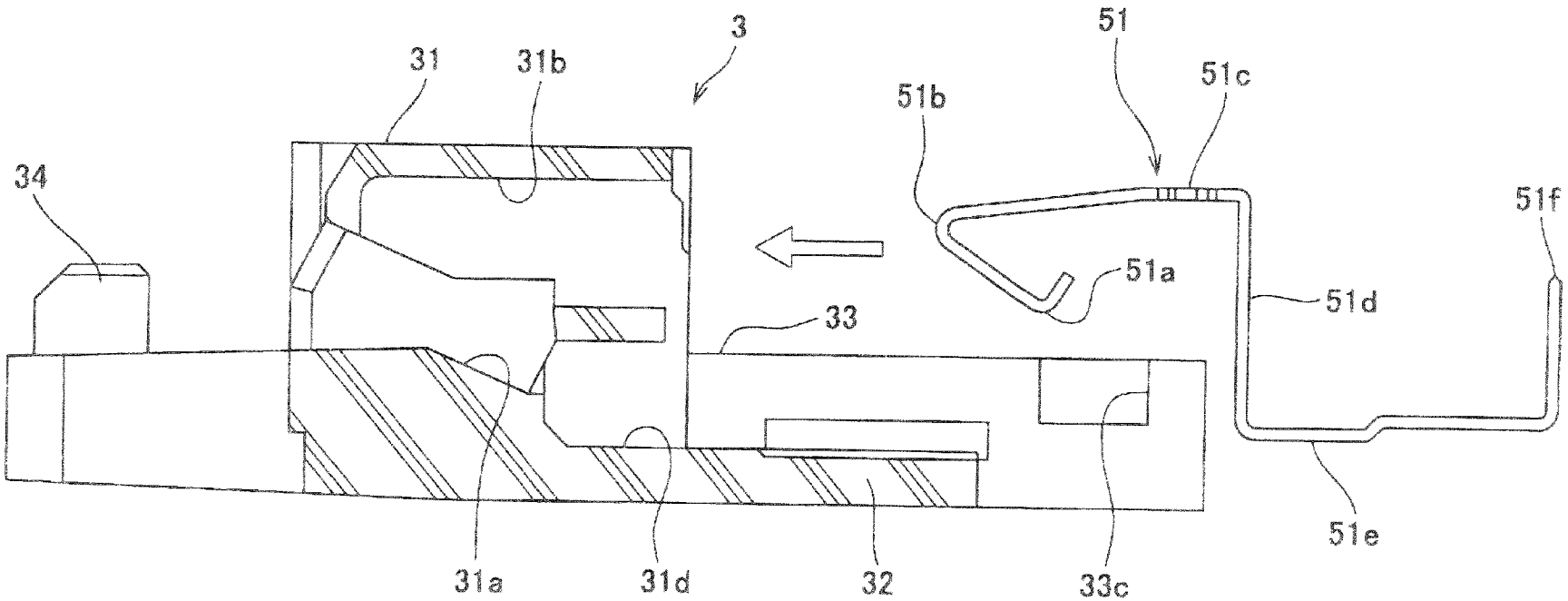
FIG. 11 is a cross-sectional view of the connector shown in FIGS. 1A to 1C in a state before upper contacts are inserted into a housing of the connector.

Referring to FIG. 11, an upper contact 51 is comprised of a contact portion (upper contact portion) 51*a*, a spring portion 51*b*, a press-fitting portion 51*c*, a vertical portion 51*d*, a horizontal portion 51*e* and a terminal portion (upper connecting portion) 51*f*.

The contact portion 51*a* is brought into contact with an associated one of pads 21*a* (see FIG. 15) formed on an upper surface of the foremost end of the circuit card 21 inserted into the receiving space 31*a*. The spring portion 51*b* is continuous with the contact portion 51*a*, and urges the contact portion 51*a* against the pad 21*a*. The press-fitting portion 51*c* is continuous with the spring portion 51*b*, and is press-fitted into an associated one of the upper contact-inserting portions 31*b*. The vertical portion 51*d* is continuous with the press-fitting portion 51*c*. When the connector 1 is mounted on the motherboard 22, and the motherboard 22 is supported in a horizontal position, the vertical portion 51*d* becomes substantially parallel to a perpendicular line. The horizontal portion 51*e* is continuous with the vertical portion 51*d*. When the connector 1 is mounted on the motherboard 22, and the motherboard 22 is supported in the horizontal position, the horizontal portion 51*e* is located on a lower surface side of the motherboard 22 and becomes substantially horizontal. The length of the horizontal portion 51*e* of the upper contact 51 varies with the type of the upper contact 51. The terminal portion 51*f* is pin-shaped, and is continuous with the horizontal portion 51*e*. The upper contacts 51 of the present connector 1 include three types of contacts having respective horizontal portions 51*e* different in length, which enables the terminal portions 51*f* to be arranged in three rows in the front-rear direction. The arrangement of the terminal portions 51*f* are arranged in a manner associated with through holes 22*b* (see FIG. 16) of the motherboard 22. The terminal portions 51*f* are inserted into respective associated ones of the through holes 22*b* of the motherboard 22, and are soldered thereto. The spring portion 51*b*, the press-fitting portion 51*c*, the vertical portion 51*d*, and the horizontal portion 51*e* form a connecting portion connecting between the contact portion 51*a* and the terminal portion 51*f*.

Each upper contact 51 is inserted into the housing 3 from the rear side of the housing body 31. At this time, the contact portion 51*a* and the spring portion 51*b* are inserted into the upper contact-inserting portion 31*b*, and the press-fitting portion 51*c* is press-fitted into the upper contact-inserting portion 31*b*. As a result, the upper contact 51 is fixed to the housing 3. The contact portion 51*a* of the upper contact 51 fixed to the housing 3 protrude into the receiving space 31*a*, and the terminal portion 51*f* is disposed above the locator-disposing portion 32.

Figure 12:
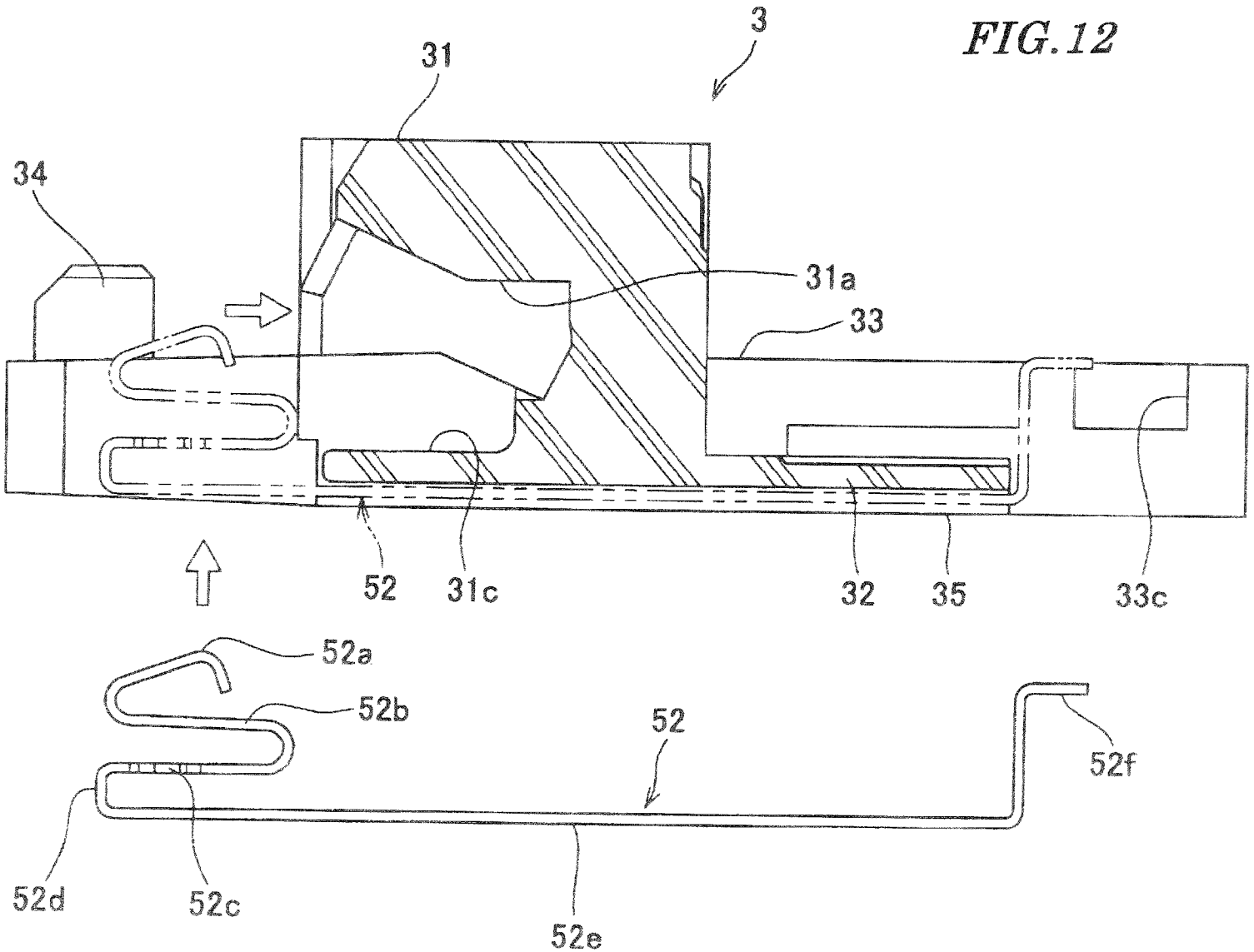
FIG. 12 is a cross-sectional view of the connector shown in FIGS. 1A to 1C in a state before lower contacts are inserted into the housing of the connector.

Referring to FIG. 12, a lower contact 52 is comprised of a contact portion (lower contact portion) 52*a*, a spring portion 52*b*, a press-fitting portion 52*c*, a folded portion 52*d*, an intermediate portion 52*e*, and a terminal portion (lower connecting portion) 52*f*.

The contact portion 52*a* is brought into contact with an associated one of pads, not shown, formed on a lower surface of the foremost end of the circuit card 21 inserted into the receiving space 31*a*. The spring portion 52*b* is continuous with the contact portion 52*a*, and urges the contact portion 52*a* against the pad 21*a*. The press-fitting portion 52*c* is continuous with the spring portion 52*b*, and is press-fitted into an associated one of the lower contact-inserting portions 31*c*. The folded portion 52*d* is continuous with the press-fitting portion 52*c*, and is folded backward. The intermediate portion 52*e* extends between the folded portion 52*d* and the terminal portion 52*f*, and is disposed between the ribs 35 (see FIG. 10). The terminal portion 52*f* has a surface-mountable planar shape, and is soldered to an associated one of pads, not shown, formed on the lower surface of the motherboard 22. The spring portion 52*b*, the press-fitting portion 52*c*, the folded portion 52*d*, and the intermediate portion 52*e* form a connecting portion connecting between the contact portion 52*a* and the terminal portion 52*f*.

To fix the lower contact 52 to the housing 3, first, the lower contact 52 indicated by solid lines in FIG. 12, is moved to a position of the lower contact 52 indicated by imaginary lines, from under the housing 3. Next, the lower contact 52 is inserted into the housing 3 from the front side of the housing body 31. At this time, by urging the folded portion 52*d* backward, the contact portion 52*a* is inserted into the receiving space 31*a*, while the spring portion 52*b* is inserted into an associated one of the lower contact-inserting portions 31*c* and the press-fitting portion 52*c* is press-fitted into an associated one of the lower contact-inserting portions 31*c*. As a result, the lower contact 52 is fixed to the housing 3. The contact portion 52*a* of the lower contact 52 protrudes into the receiving space 31*a*, and the terminal portion 52*f* is disposed at a location rearward of the locator-disposing portion 32.

Figure 13:
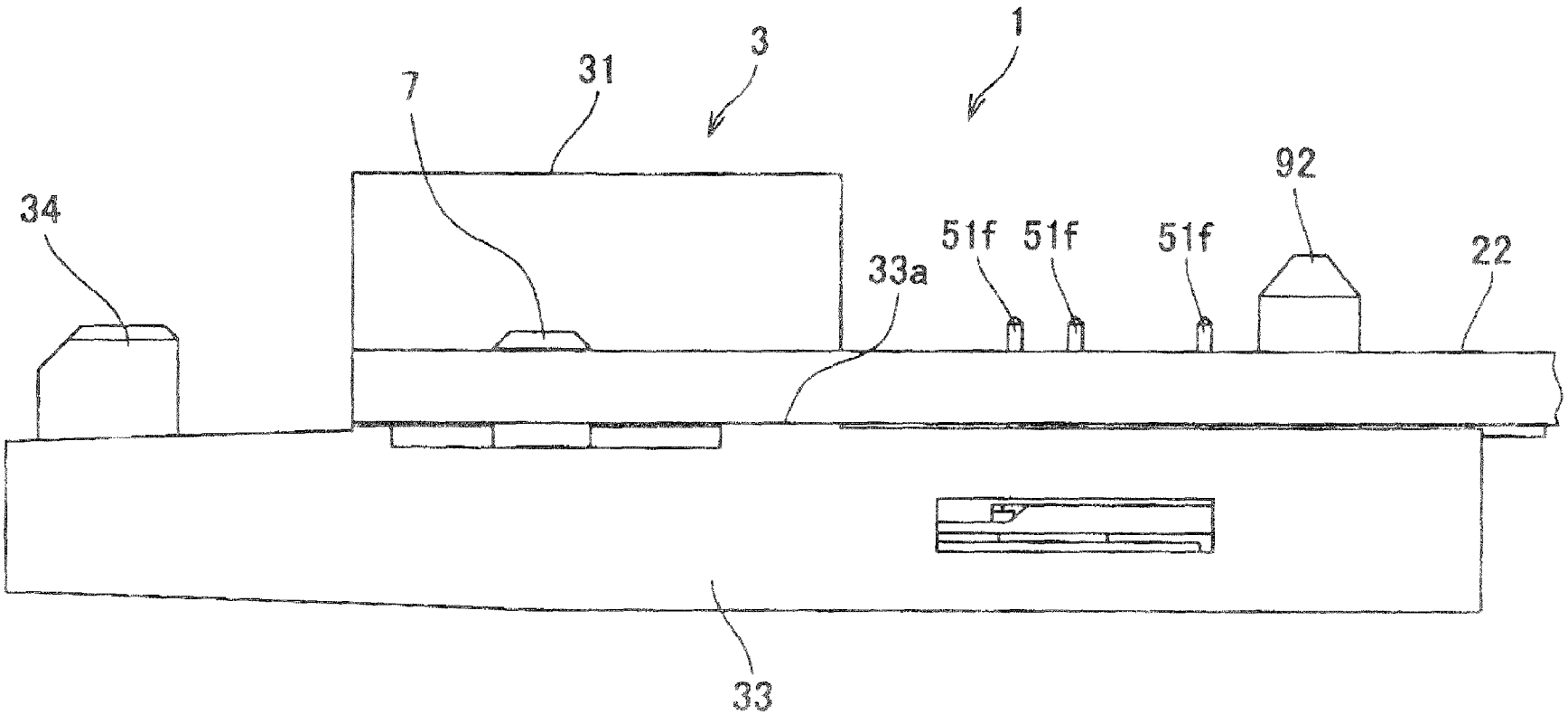
FIG. 13 is a side view of the connector shown in FIGS. 1A to 1C and a motherboard in a state in which the connector is mounted on a front edge of the motherboard.
Figure 14:
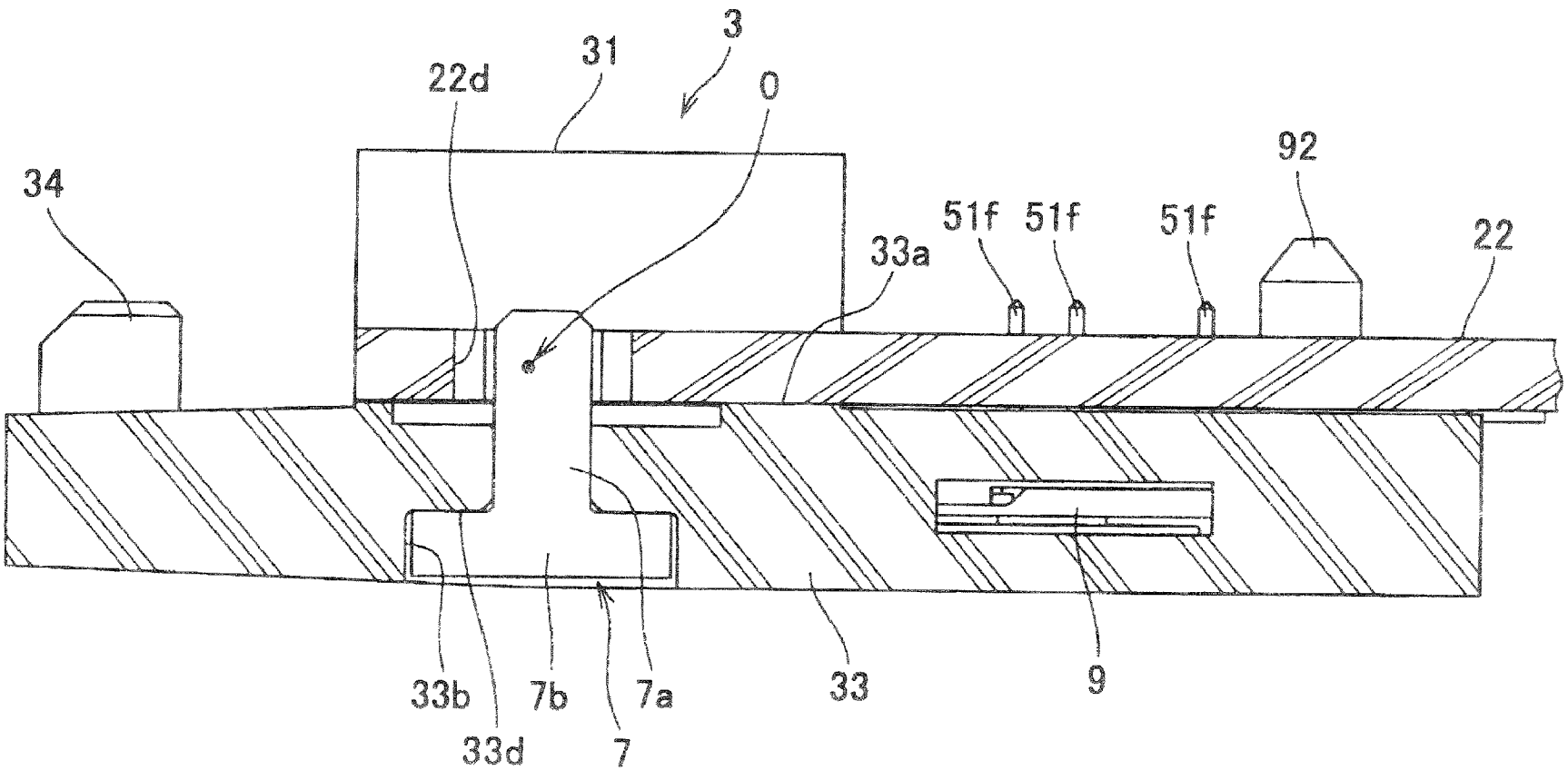
FIG. 14 is a cross-sectional view of the FIG. 13 connector taken through a flange portion and the motherboard.

As shown in FIGS. 13 and 14, each rotation stop member 7 is formed to be substantially T-shaped and includes a fixing portion 7*a* and the retaining portion 7*b*. The rotation stop member 7 is inserted into the accommodating space 33*b* of the flange portion 33 of the housing 3. An upper end of the fixing portion 7*a*, protruding from the accommodating space 33*b*, is inserted into an insertion hole 22*d* of the motherboard 22, and is soldered to the motherboard 22. The retaining portion 7*b* is continuous with the fixing portion 7*a*. A portion of the retaining portion 7*b*, toward the circuit card 21, is positioned at a location forward of the rotation center O.

As shown in FIGS. 1B, 2, 3, 5, 7 and 8, the locator 9 is substantially plate-shaped, and includes a plurality of holes 91, two positioning bosses 92, a plurality of ribs 93, and protrusions 94.

The plurality of terminal portions 51*f* of the upper contacts 51 are inserted into the plurality of holes 91, whereby they are aligned. The positioning bosses 92 are formed on upper surfaces of opposite ends of the locator 9 in the direction of the length thereof. When the positioning bosses 92 are inserted into positioning holes 22*c* of the motherboard 22, the locator 9 is positioned with respect to the motherboard 22. The ribs 93 are formed on the bottom surface of the locator 9 at equally-spaced intervals in the direction of the length of the locator 9. Part of the intermediate portion 52*e* of each lower contact 52 is received between associated ones of the ribs 93. The protrusions 94 are formed on the opposite ends of the locator 9 in the direction of the length thereof, and are supported by the recesses 33*c* of the flange portions 33 of the housing 3.

Figure 15:
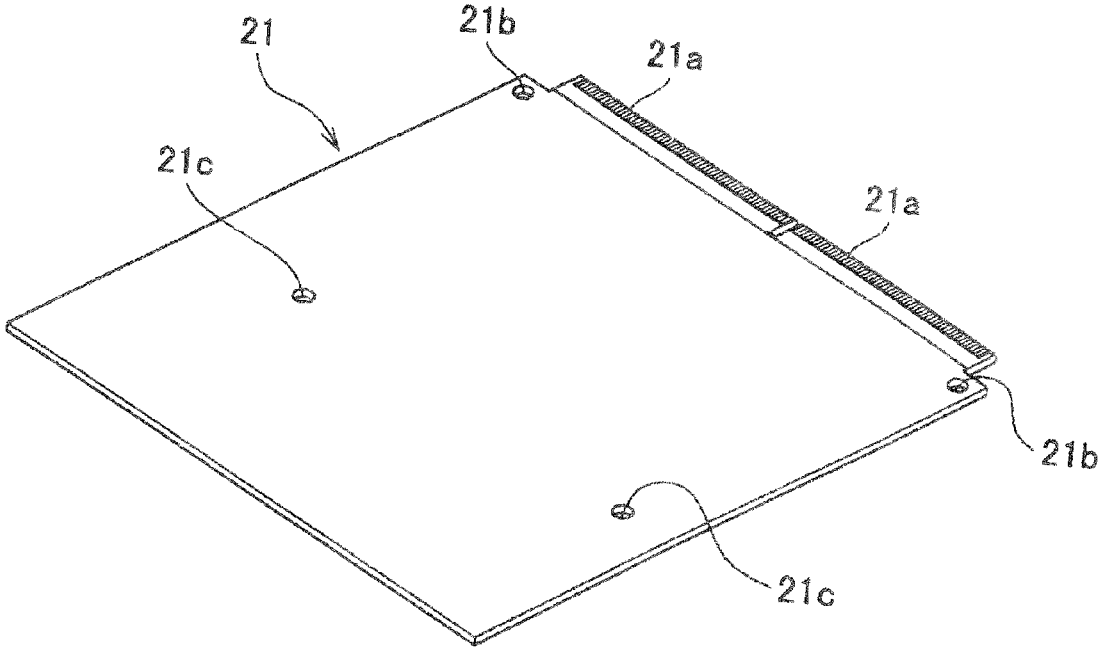
FIG. 15 is a perspective view of a circuit card inserted into the connector shown in FIGS. 1A to 1C.

Referring to FIG. 15, the pads 21*a* are formed on the upper surface of the foremost end of the circuit card 21 at equally-spaced intervals. It should be noted that a plurality of pads (similar to the pads 21*a* on the upper surface), not shown, are also formed on the lower surface of the foremost end of the circuit card 21 at equally-spaced intervals. The two positioning holes 21*b* are formed through opposite ends of the foremost end of the circuit card 21. Two mounting holes 21*c* are formed through a rear portion of the circuit card 21.

Figure 16:
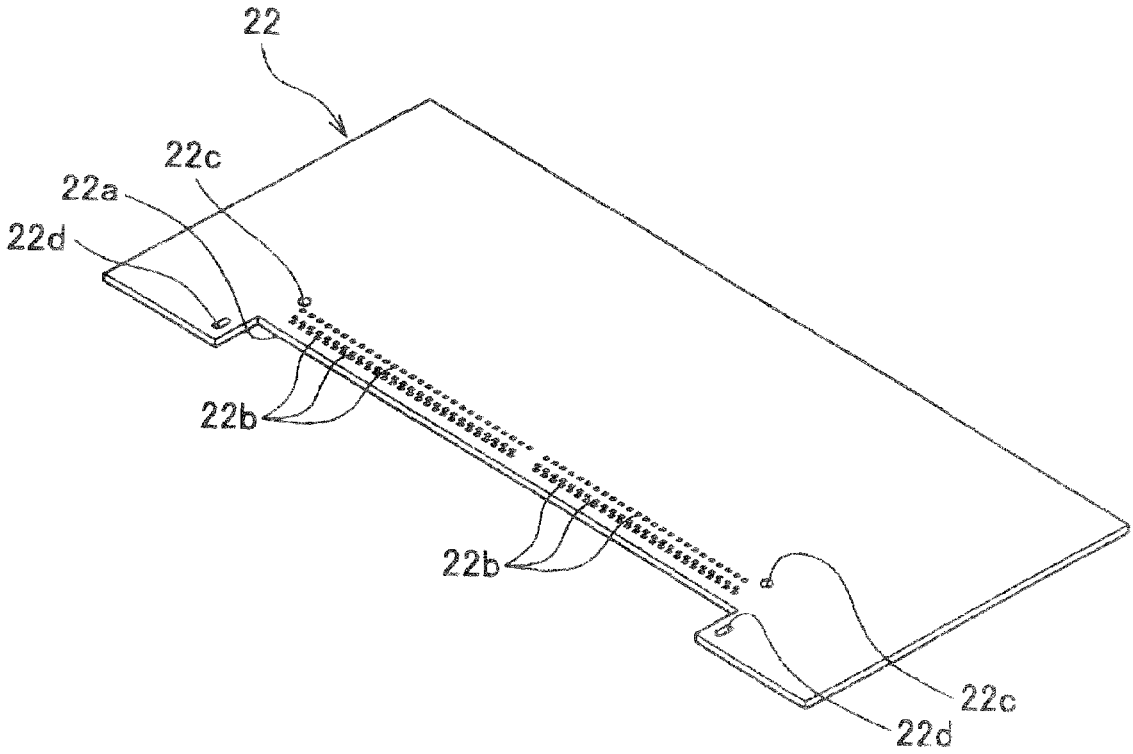
FIG. 16 is a perspective view of the motherboard on which the connector shown in FIGS. 1A to 1C is mounted.

Referring to FIG. 16, a cutout 22*a* is formed in the front edge of the motherboard 22. A plurality of through holes 22*b* are formed at a location rearward of the cutout 22*a* at equally-spaced intervals in three rows in the front-rear direction. Although the through holes 22*b* are arranged at an equal pitch in the respective rows, the through holes 22*b* are slightly displaced from each other in a pitch direction of the through holes 22*b* such that the through holes 22*b* in the respective rows are not arranged on the same straight lines in the front-rear direction. The positioning holes 22*c* are formed at a location rearward of the through holes 22*b*. The insertion holes 22*d* are formed in the respective opposite sides of the cutout 22*a*. It should be noted that a plurality of pads, not shown, are formed on the lower surface of the motherboard 22 at equally-spaced intervals.

Figure 17A:
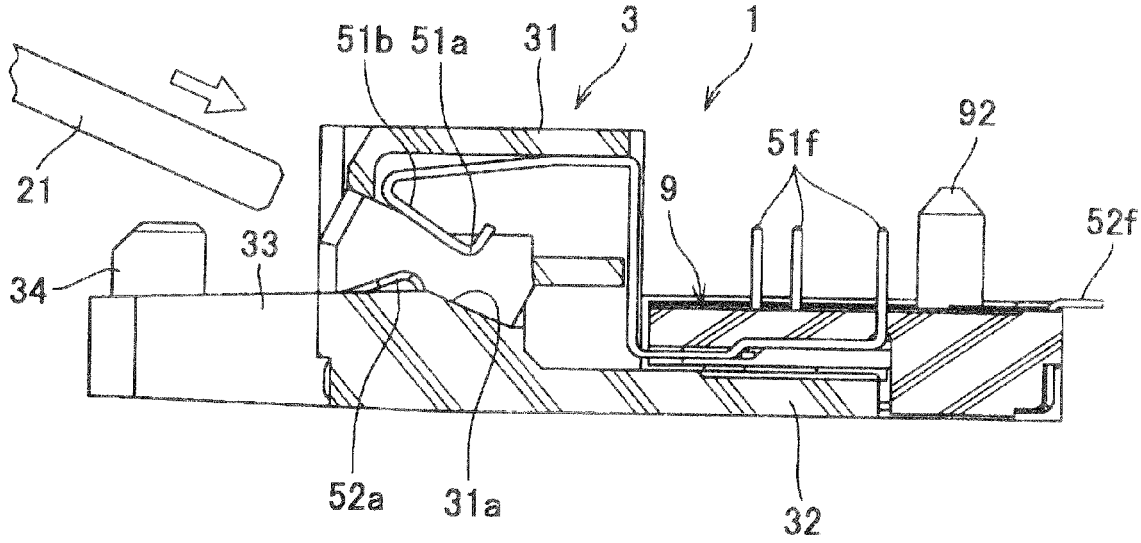
FIG. 17A is a cross-sectional view of the connector shown in FIGS. 1A to 1C and the circuit card in a state before the circuit card is inserted into the connector.

To connect the circuit card 21 to the motherboard 22 using the connector 1, first, as shown in FIG. 17A, the circuit card 21 is inserted into the receiving space 31*a* of the housing 3 from the front side of the housing body 31 with the circuit card 21 obliquely inclined.

Figure 17B:
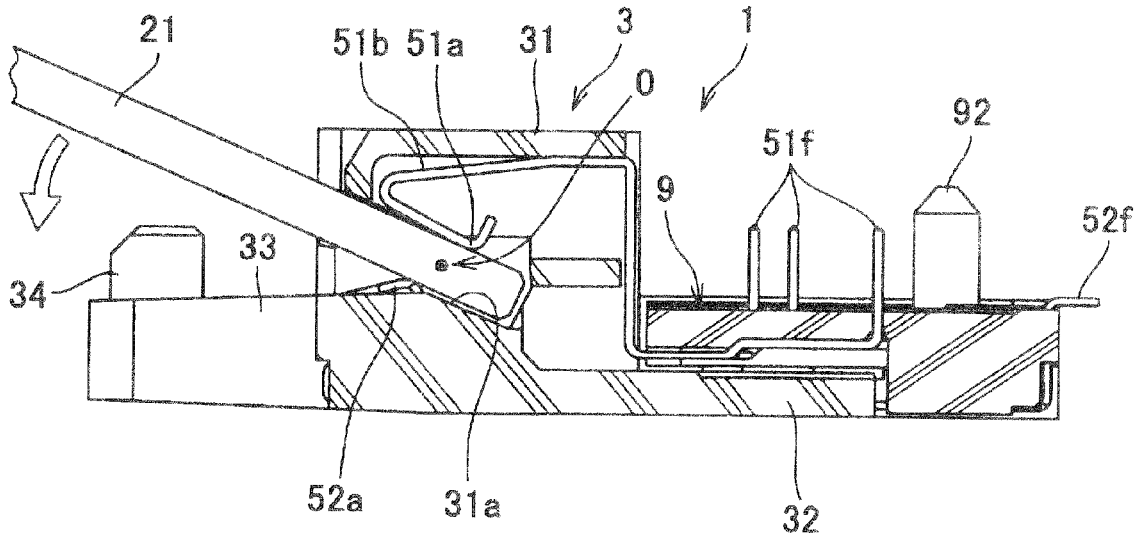
FIG. 17B is a cross-sectional view of the FIG. 17A connector and circuit card in a state in which the circuit card is obliquely inserted into the connector.

As shown in FIG. 17B, after the circuit card 21 is obliquely inserted into the receiving space 31*a*, the circuit card 21 is rotated about a portion thereof toward the foremost end in a direction indicated by an arrow.

Figure 17C:
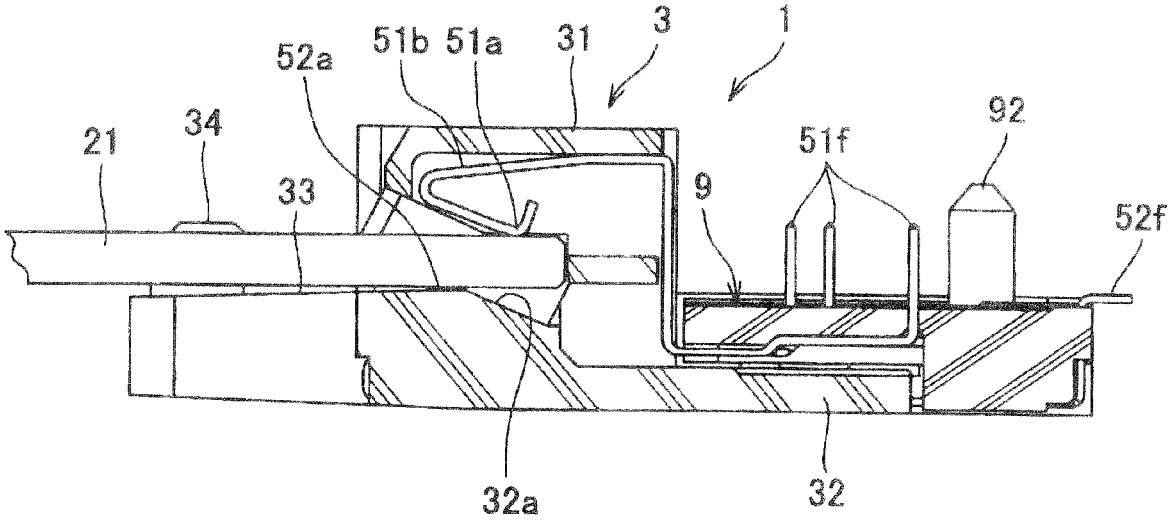
FIG. 17C is a cross-sectional view of the FIG. 17B connector and circuit card in a state in which the circuit card inserted into the connector is rotated until the circuit card is placed in a horizontal position.

As a result, as shown in FIG. 17C, the pads 21*a* formed on the opposite surfaces of the circuit card 21 and the contact portions 51*a* and 52*a* of the upper and lower contacts 51 and 52 are brought into strong contact with each other, whereby the pads 21*a* and the contact portions 51*a* and 52*a* are made electrically conductive to each other. As described above, the circuit card 21 and the motherboard 22 are electrically connected (although in FIGS. 17A to 17C, the motherboard 22 is omitted, it is assumed that the connector 1 is mounted on the motherboard 22).

Figure 18A:
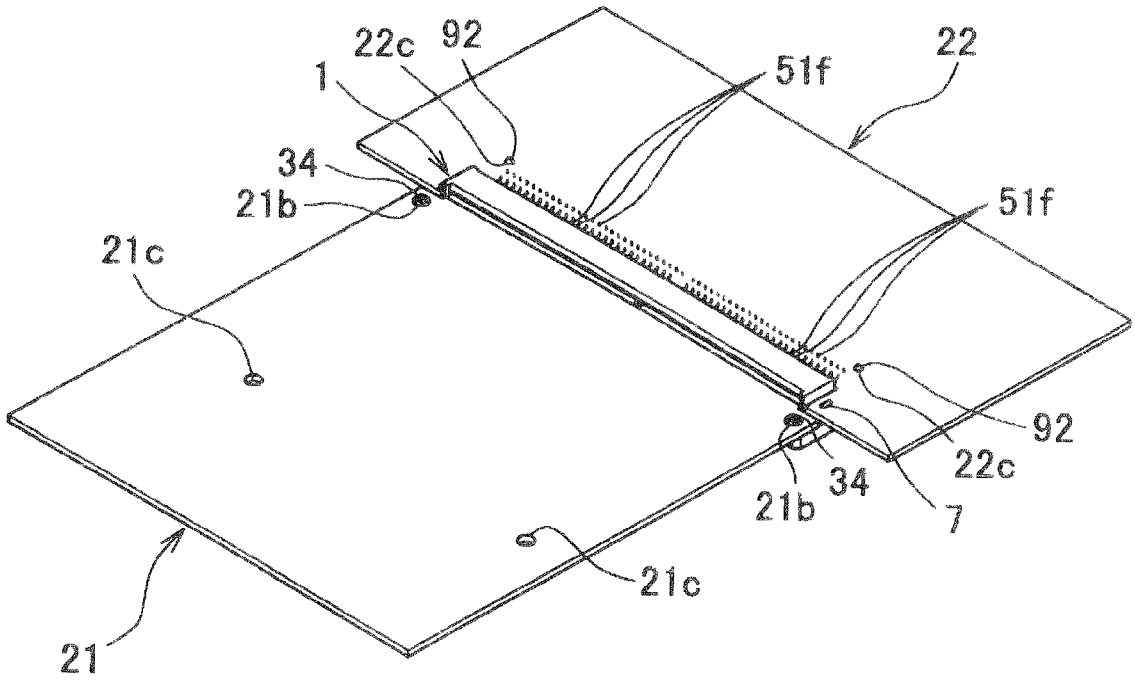
FIG. 18A is a perspective view of the connector shown in FIGS. 1A to 1C, the motherboard, and the circuit card in a state the circuit card is connected to the motherboard by the connector.
Figure 18B:
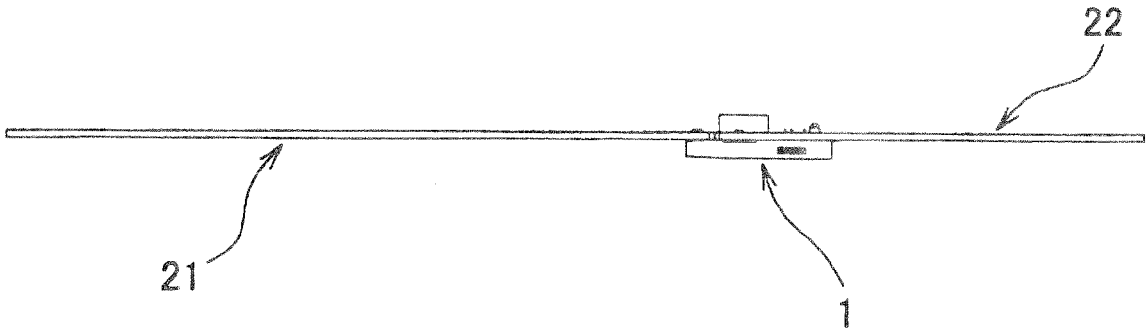
FIG. 18B is a side view of the FIG. 18A connector, motherboard, and circuit card.
Figure 18C:
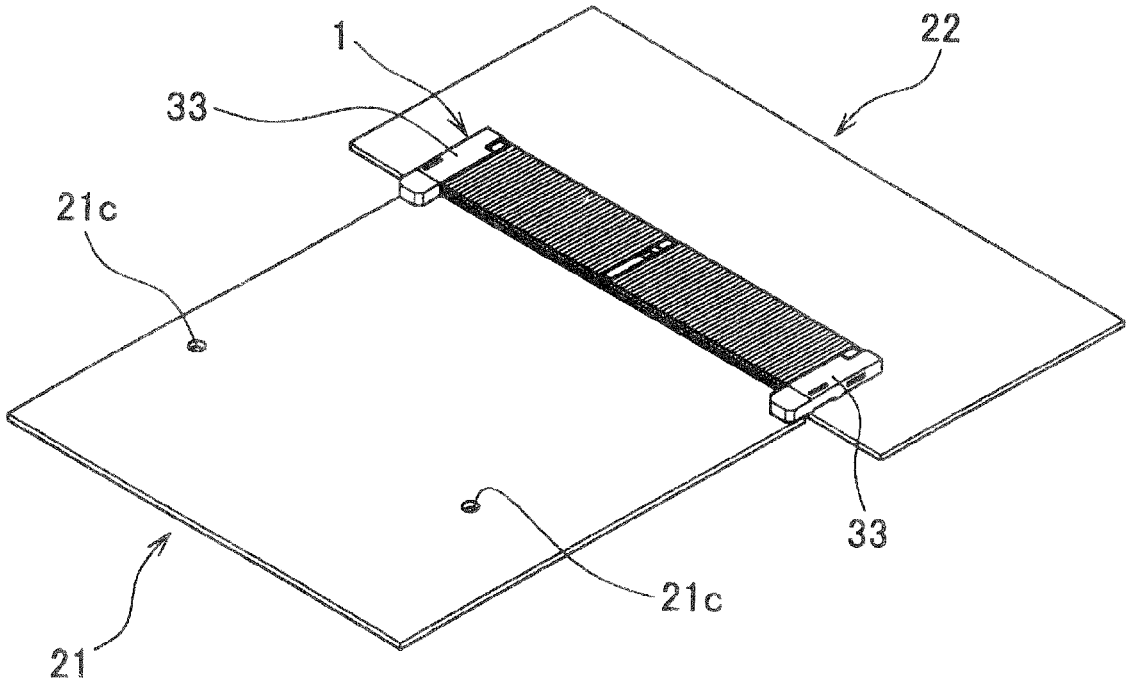
FIG. 18C is a perspective view of the FIG. 18A connector, motherboard, and circuit card, in a state presented in inverted positions thereof.

Further, as shown in FIGS. 18A and 18B, the circuit card 21 and the motherboard 22 are arranged on substantially the same plane.

Figure 19B:
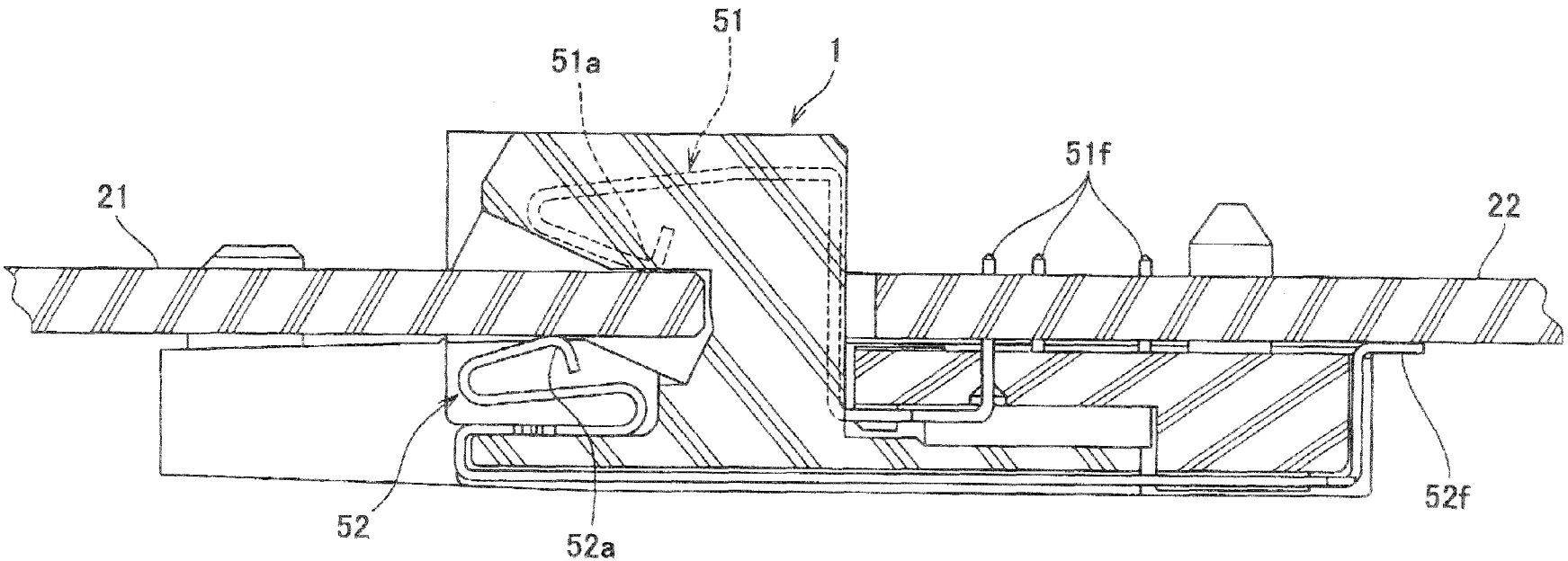
FIG. 19B is an enlarged view of the FIG. 19A connector.

As shown in FIGS. 19A and 19B, the connection between the circuit card 21 and the motherboard 22 is maintained by fixing the motherboard 22 to struts 23*a* of a housing 23 of a PC (personal computer), not shown, with associated bolts 24, while fixing the circuit card 21 to struts 23*b* of the housing 23 with associated bolts 25.

According to the present embodiment, it is possible not only to dispose the receiving space 31*a* of the housing 3 at a location toward a side of the motherboard 22 but also set the position of the receiving space 31*a* in the direction of the height thereof to substantially the same position as that of the mounting surface of the motherboard 22. This makes it possible to electrically connect the circuit card 21 and the motherboard 22 in a state in which they are arranged on substantially the same plane, thereby making it possible to reduce a space in a vertical direction (vertical direction of the connector 1), necessary for connecting the circuit card 21 and the motherboard 22.

Further, as shown in FIG. 17B, when the circuit card 21 is rotated, the connector 1 is about to rotate about the rotation center O, as indicated by an arrow in FIG. 9. However, the rotational force of the connector 1 is transmitted to the motherboard 22 via the convex surfaces 33*a* of the flange portions 33 in contact with the bottom surface of the motherboard 22, and is transmitted to the rotation stop members 7 and the motherboard 22 via the rotation-preventing surfaces 33*d* of the flange portions 33 in contact with the retaining portions 7*b* of the rotation stop members 7. Therefore, the rotational force of the connector 1 does not directly act on soldered parts of the terminal portions, and hence no excessive loads are applied to the soldered parts, differently from the conventional connector.

Furthermore, since the intermediate portions 52*e* of the lower contacts 52 are received between the ribs 93, it is possible to perform impedance matching by adjusting the width and length of the ribs 35.

Figure 1A:
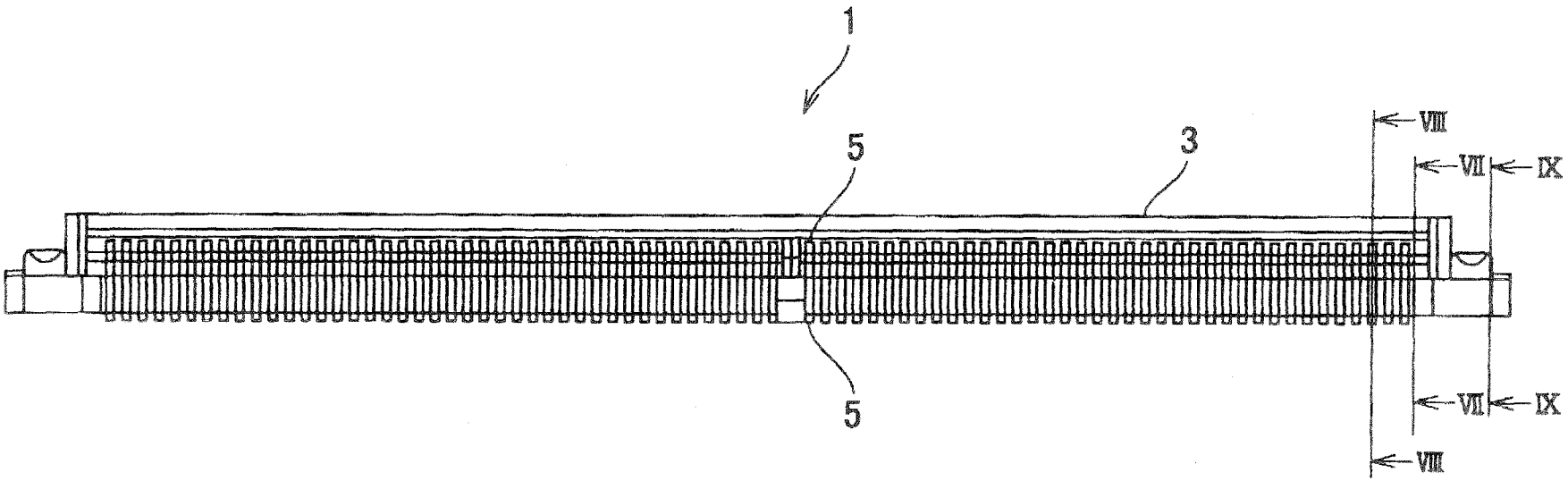
FIG. 1A is a front view of a connector according to a first embodiment of the present invention.
Figure 1B:
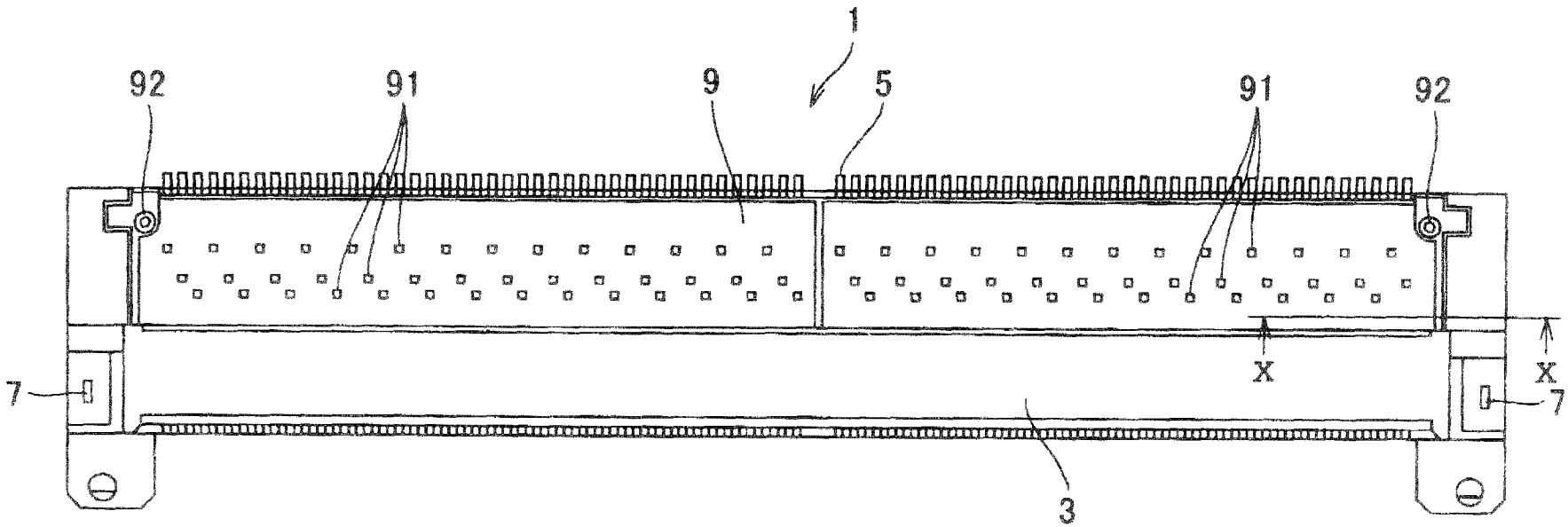
FIG. 1B is a plan view of the connector.
Figure 1C:
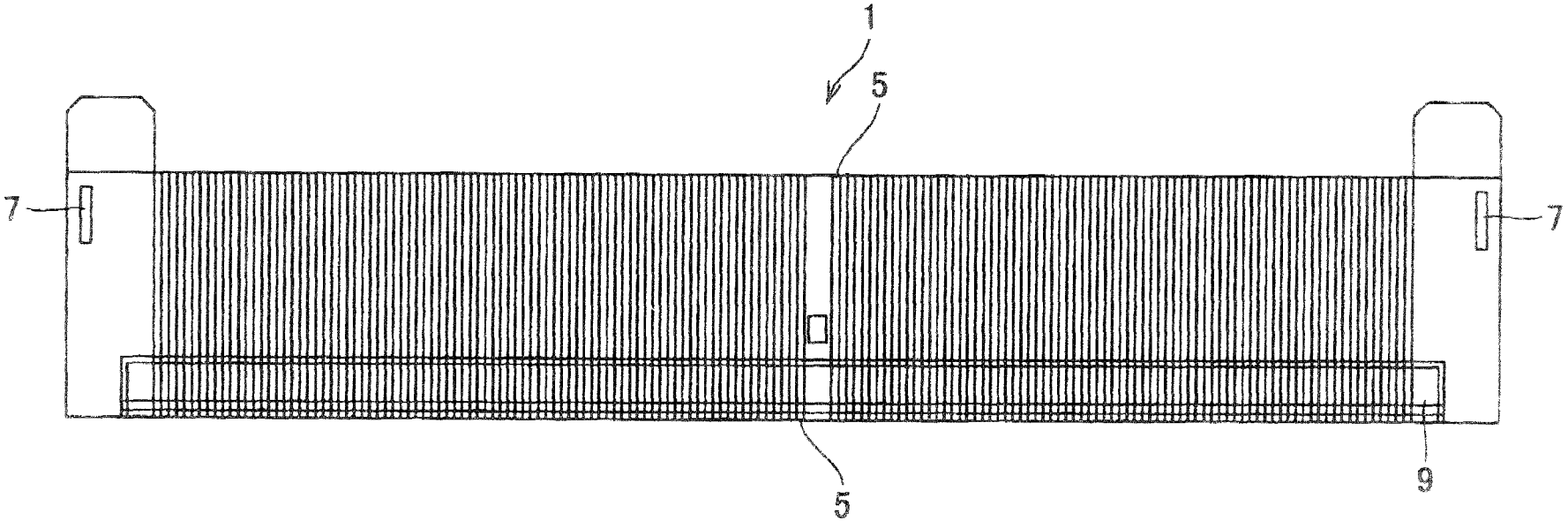
FIG. 1C is a bottom view of the connector.
Figure 2:
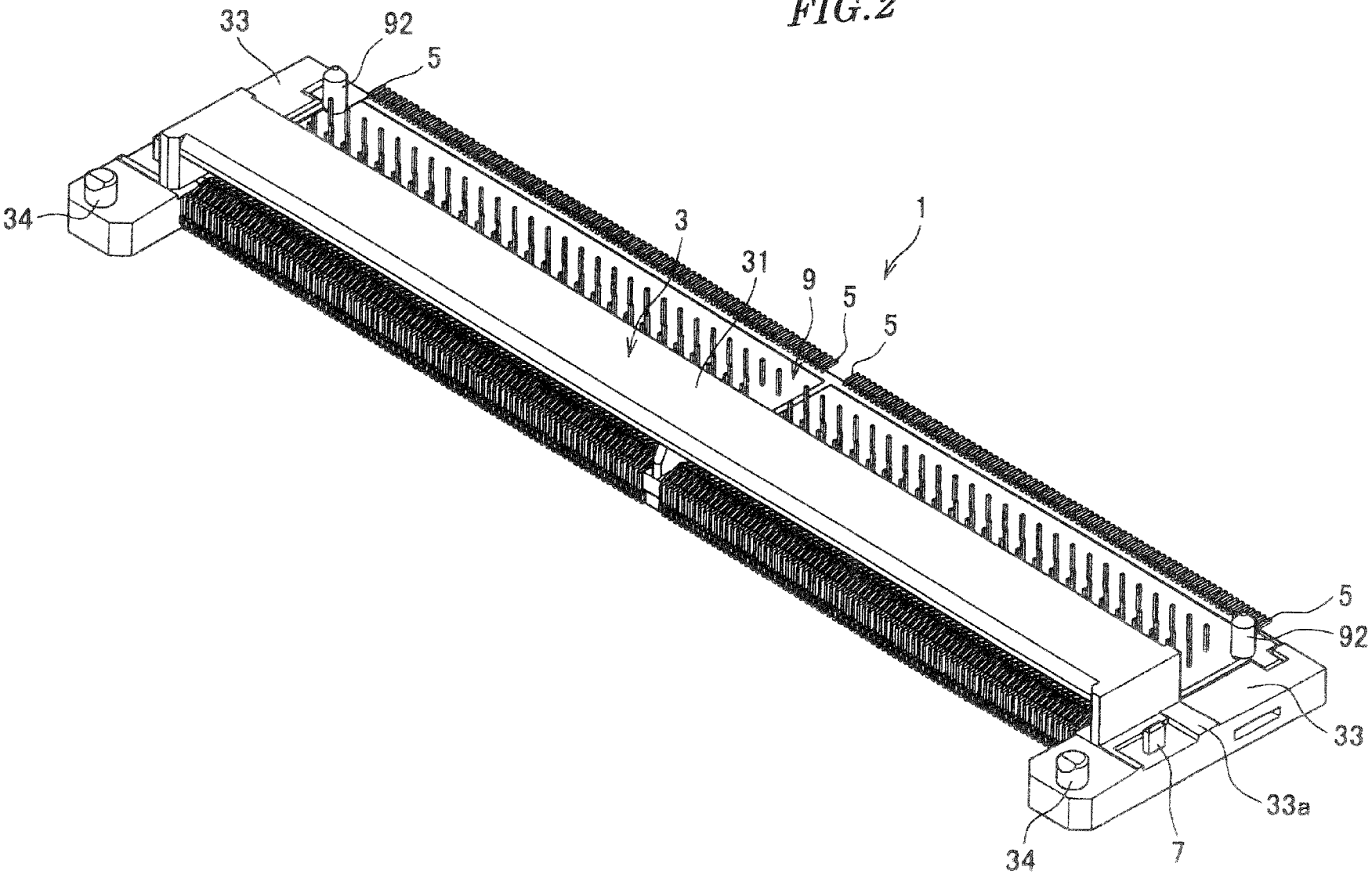
FIG. 2 is a perspective view of the connector shown in FIGS. 1A to 1C.
Figure 3:
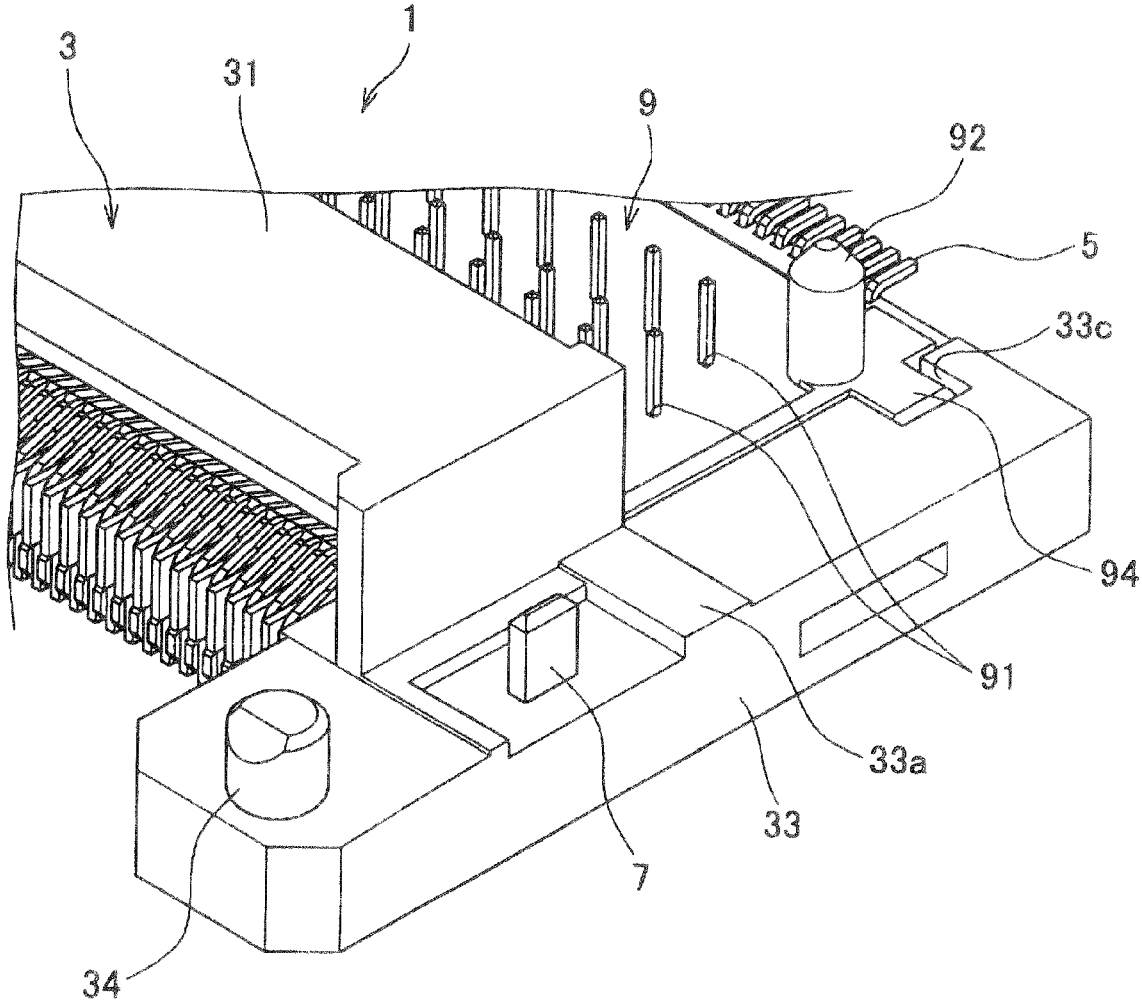
FIG. 3 is an enlarged view of a flange portion and its vicinity of the connector appearing in FIG. 2.
Figure 4:
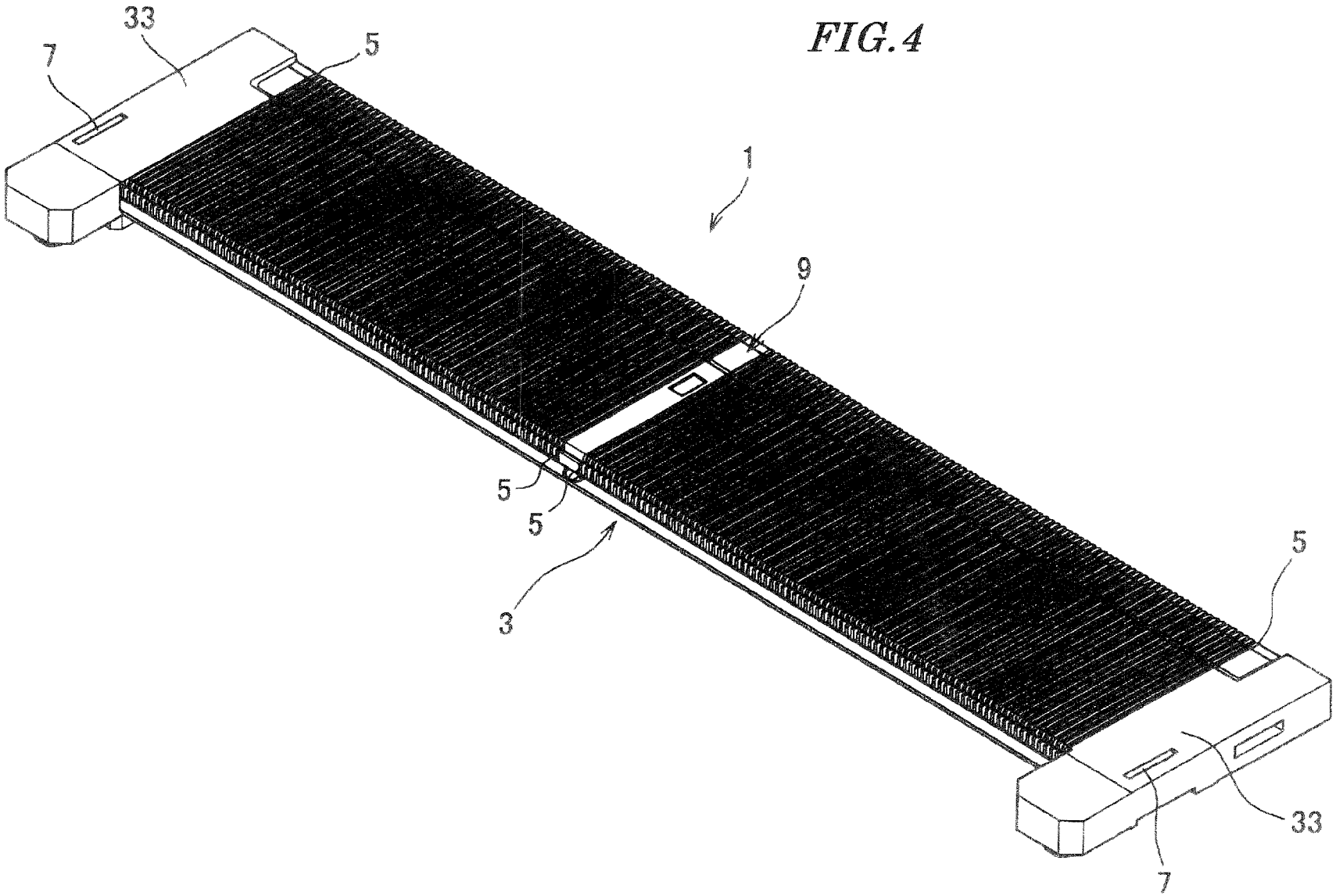
FIG. 4 is a perspective view of the connector shown in FIGS. 1A to 1C in a state presented in an inverted position.
Figure 5:
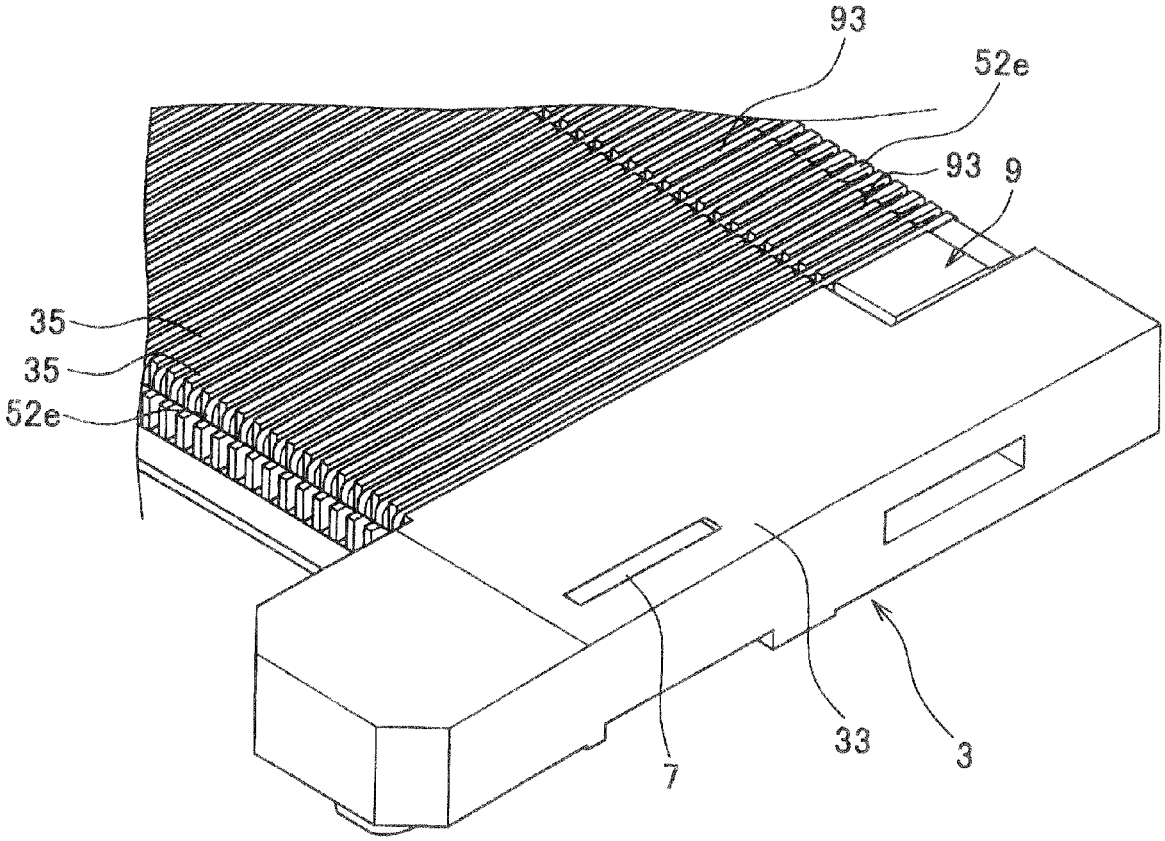
FIG. 5 is an enlarged view of the flange portion and its vicinity of the connector appearing in FIG. 4.
Figure 6:
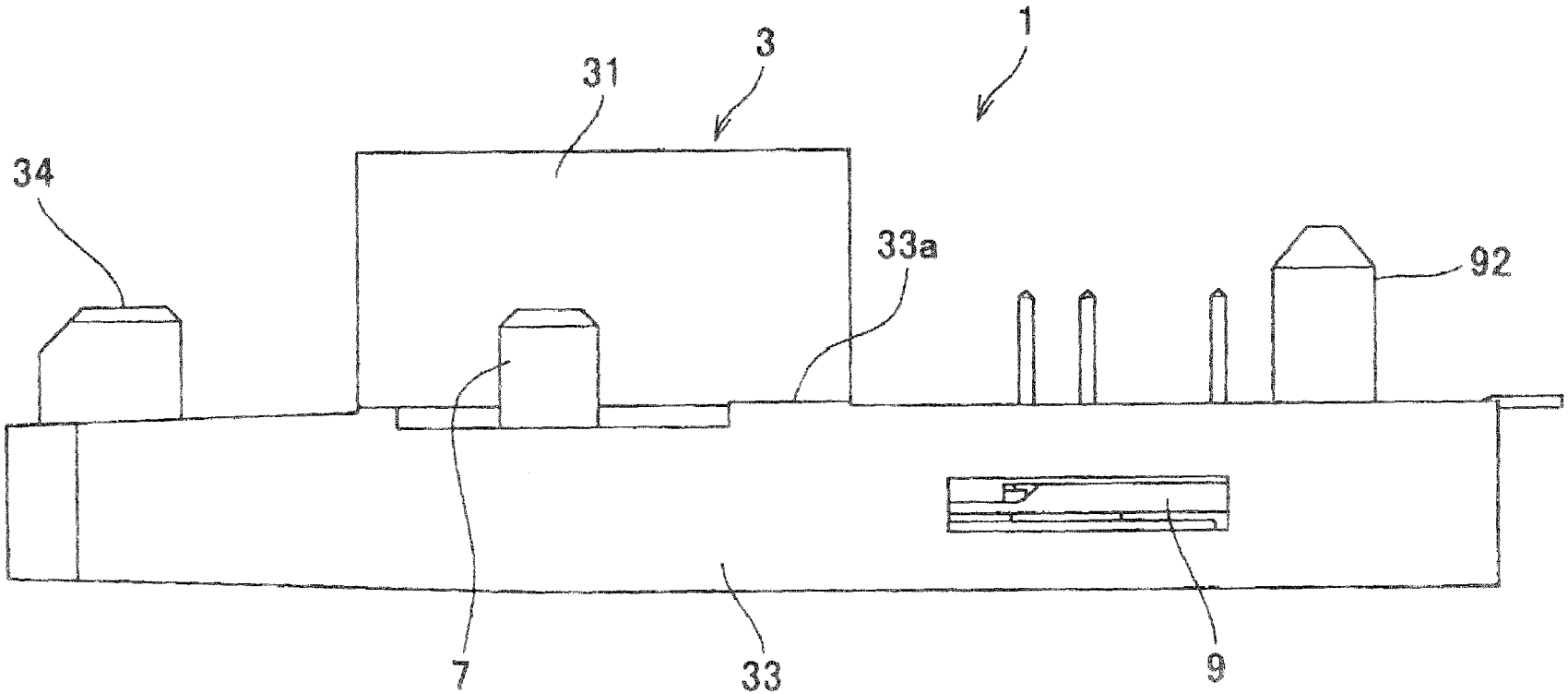
FIG. 6 is a side view of the connector shown in FIGS. 1A to 1C.
Figure 7:
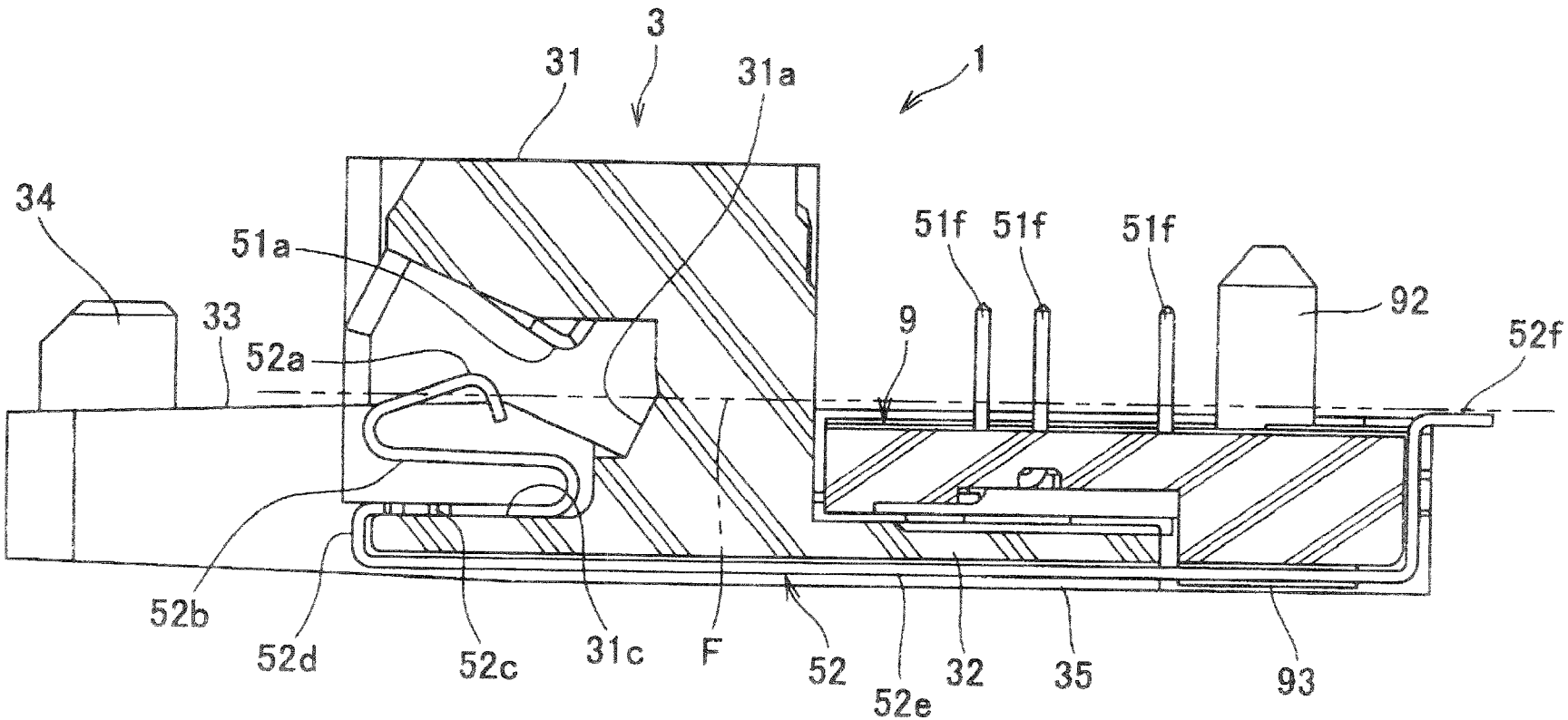
FIG. 7 is a cross-sectional view taken on line VII-VII of FIG. 1A.
Figure 8:
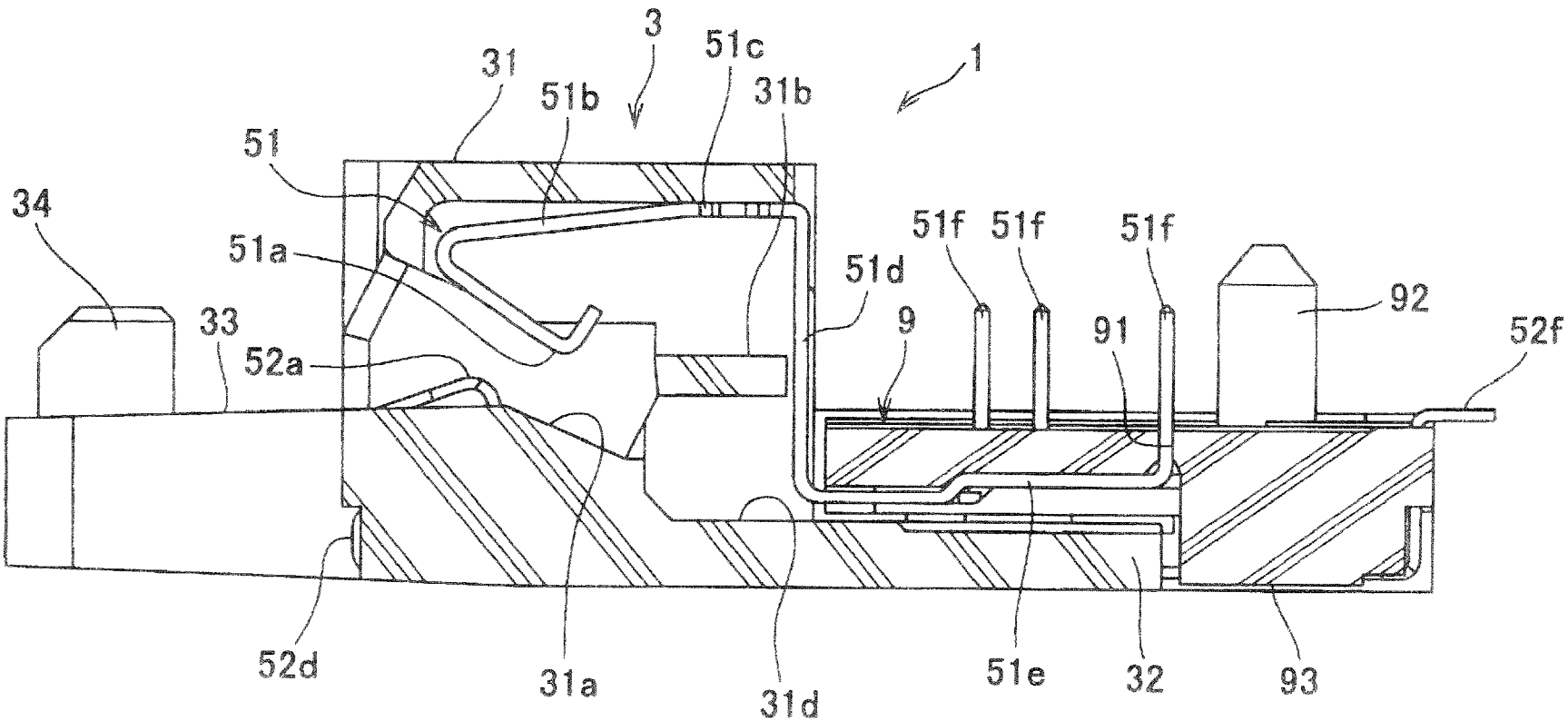
FIG. 8 is a cross-sectional view taken on line VIII-VIII of FIG. 1A.
Figure 20:
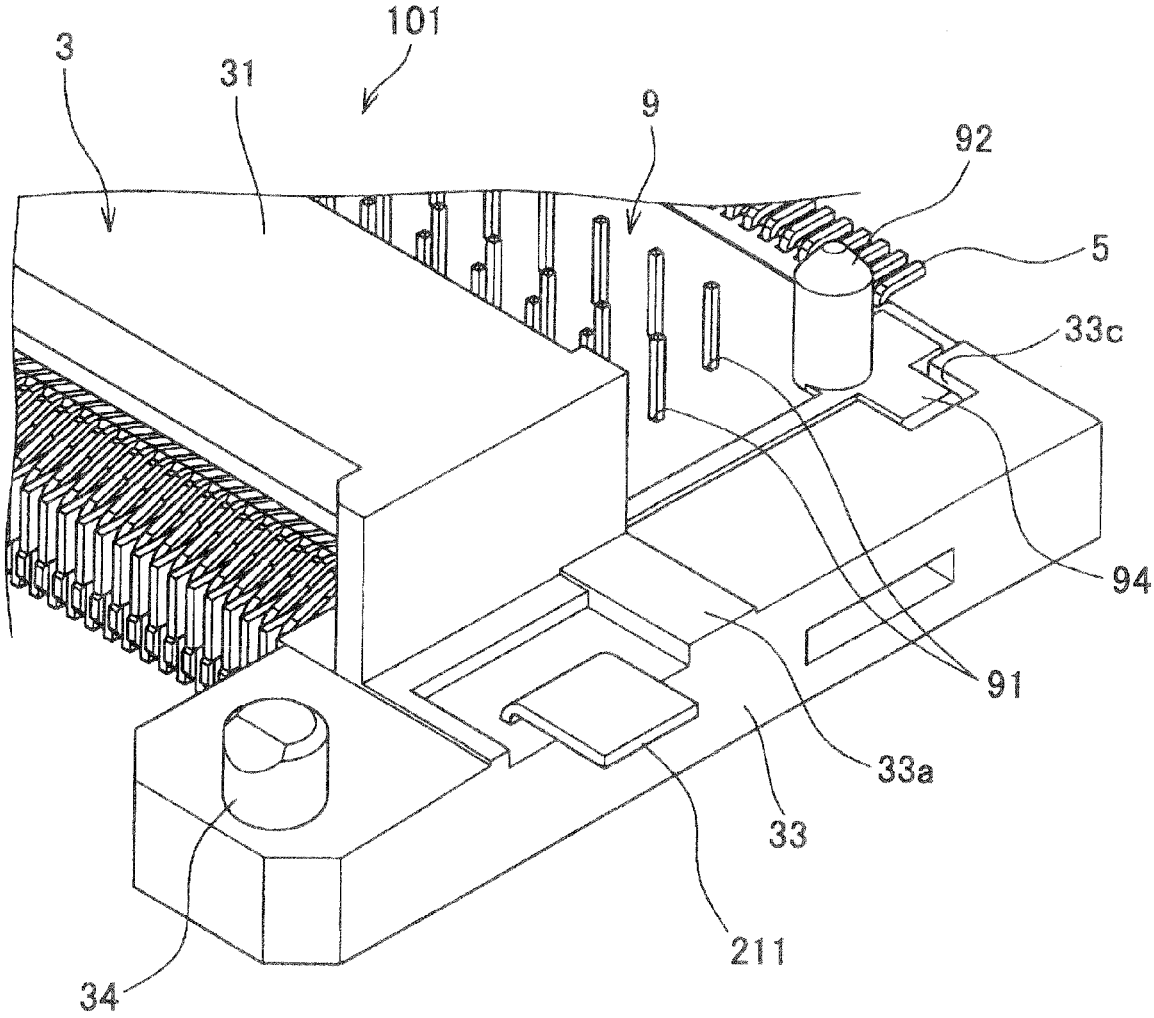
FIG. 20 is a perspective view of a flange portion and its vicinity of a variation of the connector shown in FIGS. 1A to 1C.

FIG. 20 is a perspective view of a flange portion and its vicinity of a variation of the connector shown in FIGS. 1A to 1C according to the first embodiment. Component parts identical to those of the connector according to the first embodiment are designated by identical reference numerals, and detailed description thereof is omitted.

Hereinafter, only main component parts different in construction from those of the first embodiment will be described.

In this variation, the rotation stop members 7 are replaced by holddowns 211. The holddown 211 and the rotation stop member 7 are different from each other only in the shape of a portion mounted on the motherboard 22. Similarly to the rotation stop member 7, the holddown 211 has not only a function of fixing the connector 101 to the motherboard 22 but also a function of preventing the rotation of the connector 101.

Figure 21:
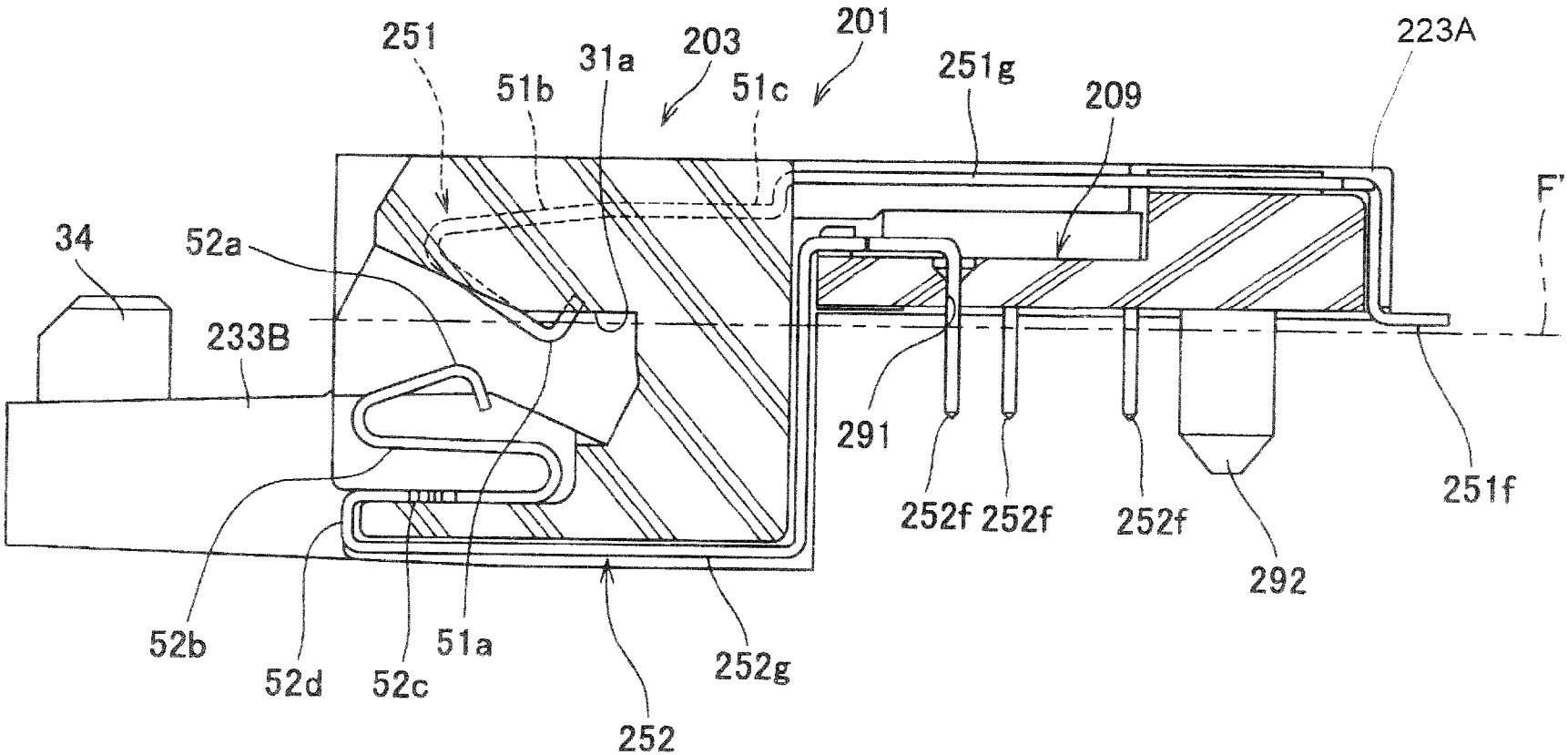
FIG. 21 is a cross-sectional view of a connector according to a second embodiment of the present invention.
Figure 22:
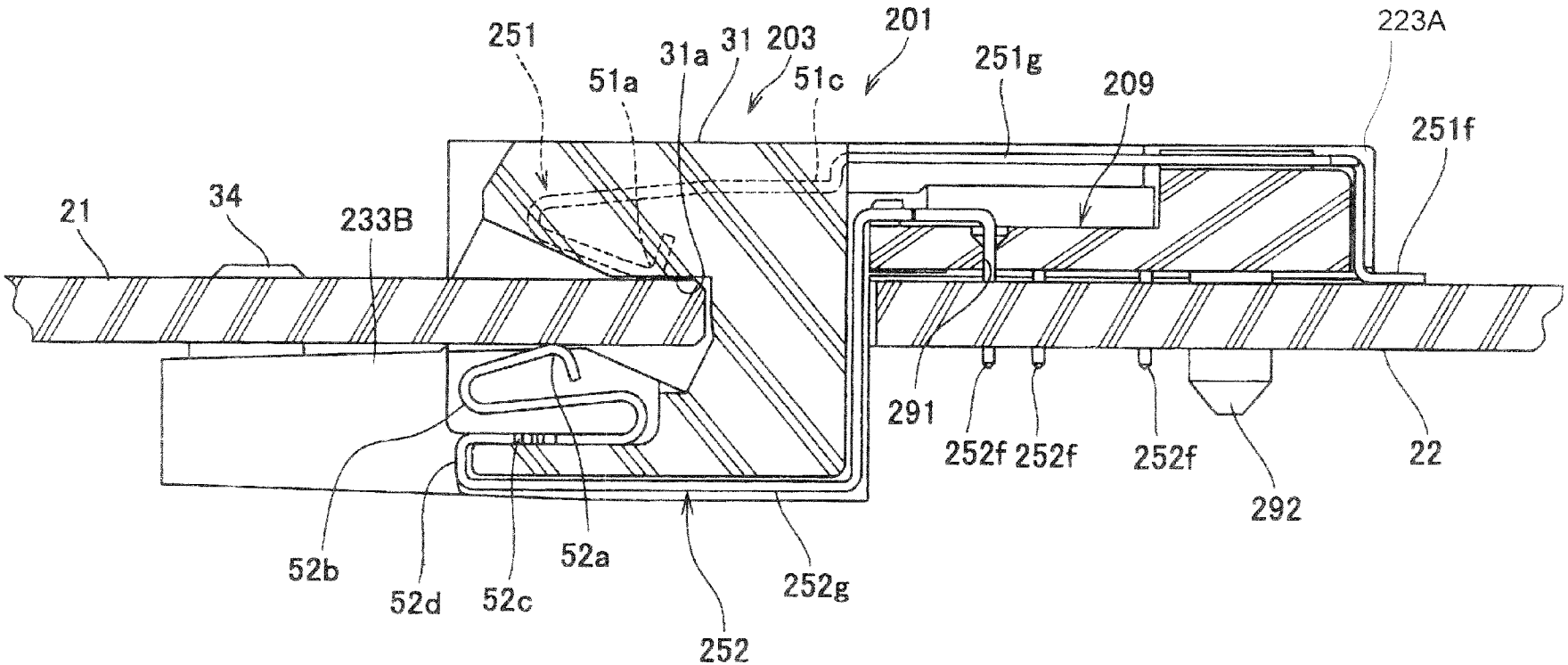
FIG. 22 is a cross-sectional view of the FIG. 21 connector, the motherboard, and the circuit card in a state in which the circuit card is connected to the motherboard by the connector.

FIG. 21 is a cross-sectional view of a connector according to a second embodiment of the present invention. FIG. 22 is a cross-sectional view of the circuit card, the FIG. 21 connector and the motherboard in a state in which the circuit card is connected to the motherboard by the connector.

Component parts identical to those of the connector according to the first embodiment are designated by identical reference numerals, and detailed description thereof is omitted. Hereinafter, only main component parts different in construction from those of the first embodiment will be described.

Although in the first embodiment, part of the connector 1 is mounted on the lower surface of the motherboard 22, in the second embodiment, part of the connector 201 is mounted on an upper surface of the motherboard 22. The receiving space 31*a* of a housing 203 is located on an imaginary extended plane F' on an upper surface (one surface) of the motherboard 22.

In the second embodiment, each flange portion of the housing 203 is comprised of a first flange 233A and a second flange 233B. The first flange 233A is continuous with an upper part of a side portion of a housing body 31, and is opposed to the upper surface of the motherboard 22.

The second flange 233B is continuous with a lower part of the side portion of the housing body 31, similarly to the flange portion 33 of the connector 1 according to the first embodiment, and is opposed to a lower surface of the circuit card 21.

A terminal portion (connecting portion) 251*f* of an upper contact 251 has a surface-mountable planar shape. The terminal portion 251*f* and the press-fitting portion 51*c* are connected by an intermediate portion 251*g*.

The spring portion 51*b*, the press-fitting portion 51*c*, and the intermediate portion 251*g* form a connecting portion connecting between the contact portion 51*a* and the terminal portion 251*f*.

A terminal portion 252*f* of a lower contact 252 is pin-shaped such that it can be inserted into an associated one of the through holes 22*b*. The terminal portion 252*f* and the folded portion 52*d* are connected by an intermediate portion 252*g*. Part of an intermediate portion 252*g* is located on an upper surface side of the motherboard 22.

The spring portion 52*b*, the press-fitting portion 52*c*, the folded portion 52*d*, and the intermediate portion 252*g* form a connecting portion connecting between the contact portion 52*a* and the terminal portion 252*f*.

Holes 291 of a locator 209 align the terminal portions 252*f* of the lower contacts 252.

According to the second embodiment, the same advantageous effects as provided by the first embodiment are obtained.

Figure 23:
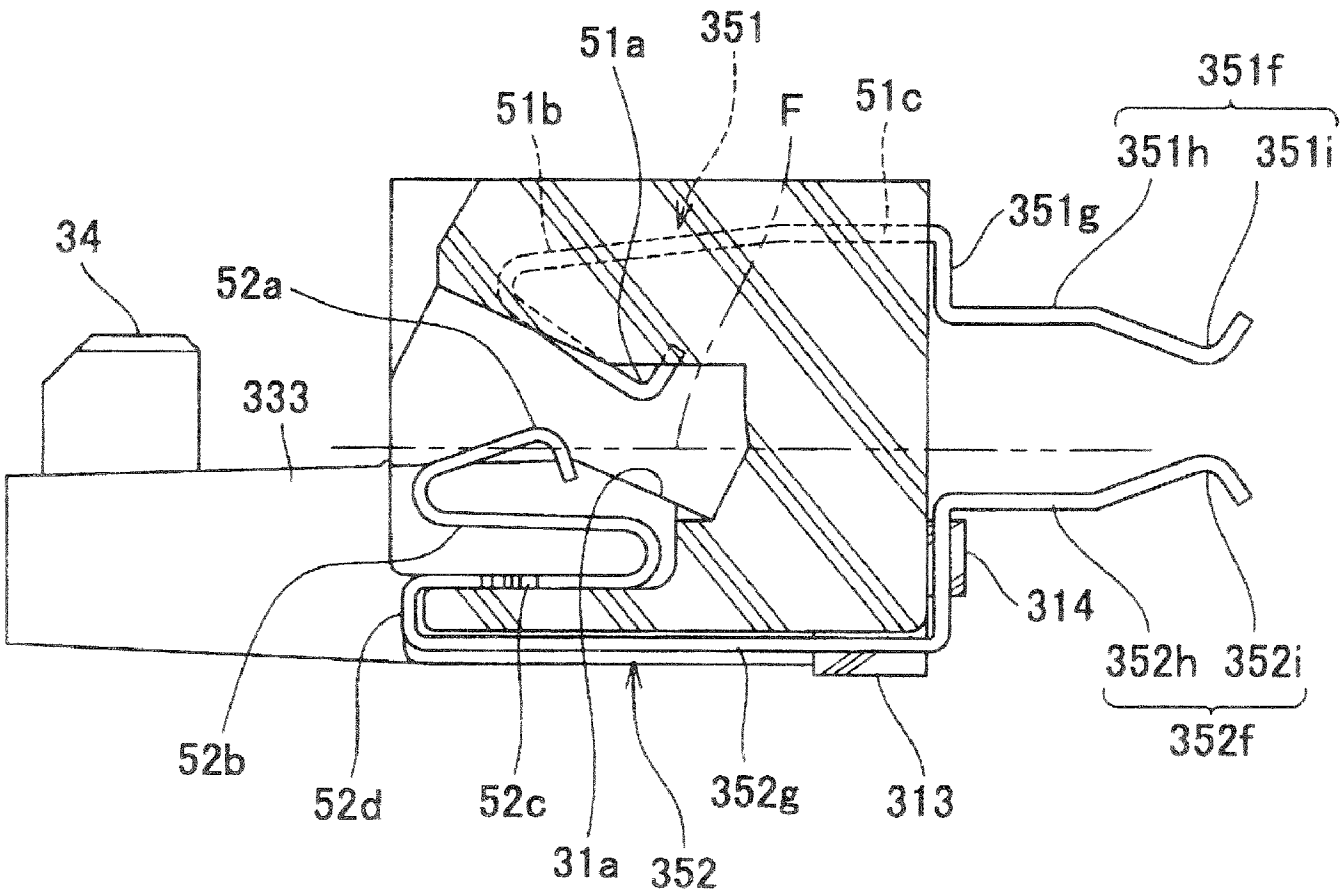
FIG. 23 is a cross-sectional view of a connector according to a third embodiment of the present invention.
Figure 24:
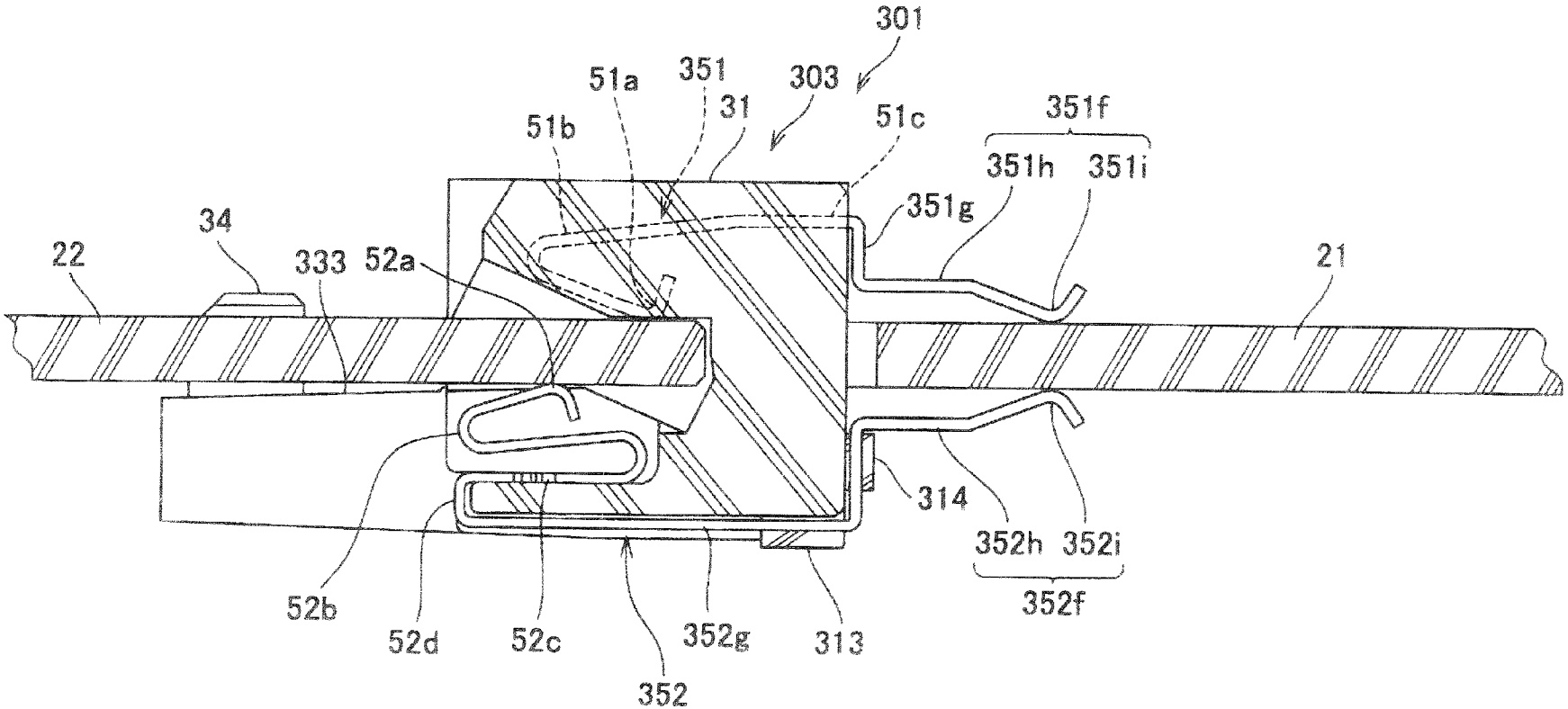
FIG. 24 is a cross-sectional view of the FIG. 23 connector, the motherboard, and the circuit card in a state in which the circuit card is connected to the motherboard by the connector.

FIG. 23 is a cross-sectional view of a connector according to a third embodiment of the present invention. FIG. 24 is a cross-sectional view of the circuit card, the FIG. 23 connector, and the motherboard in a state in which the circuit card is connected to the motherboard by the connector.

Component parts identical to those of the connector according to the first embodiment are designated by identical reference numerals, and detailed description thereof is omitted. Hereinafter, only main component parts different in construction from those of the first embodiment will be described.

The connector 301 according to the third embodiment includes upper contacts 351 each of which has a terminal portion (upper connecting portion) 351*f* comprised of a spring portion (first spring portion) 351*h* and a contact portion (first contact portion) 351*i*. The contact portion 351*i* is brought into contact with an associated one of pads, not shown, formed on the upper surface of the motherboard 22. The spring portion 351*h* urges the contact portion 351*i* against the pad. The terminal portion 351*f* and the press-fitting portion 51*c* are connected by an intermediate portion 351*g*.

The spring portion 51*b*, the press-fitting portion 51*c*, and the intermediate portion 351*g* form an upper connecting portion connecting between the contact portion 51*a* and the terminal portion 351*f*.

Similarly, the connector 301 includes lower contacts 352 each of which has a terminal portion (lower connecting portion) 352*f* comprised of a spring portion (second spring portion) 352*h* and a contact portion (second contact portion) 352*i*. The contact portion 352*i* is brought into contact with an associated one of the pads, not shown, formed on the lower surface of the motherboard 22. The spring portion 352*h* urges the contact portion 352*i* against the pad. The terminal portion 352*f* and the folded portion 52*d* are connected by an intermediate portion 352*g*. The intermediate portion 352*g* is fixed to the housing body 31 by two plate-shaped fixing members 313 and 314.

The spring portion 52*b*, the press-fitting portion 52*c*, the folded portion 52*d*, and the intermediate portion 352*g* form a lower connecting portion connecting between the contact portion 52*a* and the terminal portion 352*f*.

A flange portion 333 of a housing 303 is shorter than the flange portion 33 of the connector 1 according to the first embodiment, and does not protrude from a rear surface of the housing body 31.

According to the third embodiment, the same advantageous effects as provided by the first embodiment are obtained.

It should be noted that although in the above-described embodiments, the circuit card 21 and the motherboard 22 can be connected by the connectors 1, 101, 201, and 301 in the state in which the circuit card 21 and the motherboard 22 are arranged on substantially the same plane, the circuit card 21 and the motherboard 22 may not be necessarily arranged on the same plane in the strict sense. The circuit card 21 and the motherboard 22 may be offset to some degree in the direction of the height of the connectors 1, 101, 201, and 301, on an as-needed basis.

Further, although in the above-described embodiments, the connectors of a type in which the circuit card 21 is obliquely inserted into the housings 3, 203 and 303 are used, this is not limitative, but the present invention can also be applied to connectors of a type in which the circuit card or the like is inserted into the receiving spaces of housings of the connectors in parallel with the mounting surface of the motherboard.

It is further understood by those skilled in the art that the foregoing are the preferred embodiments of the present invention, and that various changes and modification may be made thereto without departing from the spirit and scope thereof.

What is claimed is:

1. A connector for electrically connecting one plate-shaped to-be-connected object and another plate-shaped to-be-connected object, comprising:

a housing that has a receiving space for receiving one end of the one to-be-connected object, and is fixed to one or the other surface of one end of the other to-be-connected object; and a plurality of contacts that are arranged in upper and lower rows in said housing, wherein out of said plurality of contacts, a plurality of upper contacts that form the upper row are inserted into said housing from rearward of said housing, for being held by said housing, wherein out of said plurality of contacts, a plurality of lower contacts that form the lower row are inserted into said housing from forward of said housing, for being held by said housing, wherein said upper contacts each comprise an upper contact portion that is located on a front side of said housing, for being brought into contact with an upper surface of the one end of the one to-be-connected object inserted into the receiving space, an upper connecting portion that is located on a rear side of said housing, for being connected to the one end of the other to-be-connected object, and an upper connecting portion that connects between said upper contact portion and said upper connecting portion, wherein said lower contacts each comprise a lower contact portion that is located on the front side of said housing, for being brought into contact with a lower surface of the one end of the one to-be-connected object inserted into the receiving space, a lower connecting portion that is located on the rear side of said housing, for being connected to the one end of the other to-be-connected object, and a lower connecting portion that connects between said lower contact portion and said lower connecting portion, and wherein the receiving space is located on an imaginary extended plane of one or the other surface of the one end of the other to-be-connected object.

2. A connector as claimed in claim 1, wherein part of said lower connecting portion extends from the front side to the rear side of said housing along a bottom surface of said housing.

3. A connector as claimed in claim 2, wherein a plurality of ribs extending from the front side to the rear side of said housing are formed on the bottom surface of said housing, and wherein part of said lower connecting portion is received between associated ones of said ribs.

4. A connector as claimed in claim 1, wherein said upper connecting portion is pin-shaped such that said upper connecting portion can be inserted into a through hole of the other to-be-connected object, and wherein said lower connecting portion has a planar shape that can be surface-mounted on the other to-be-connected object.

5. A connector as claimed in claim 1, wherein said upper connecting portion has a planar shape that can be surface-mounted on the other to-be-connected object, and wherein said lower connecting portion is pin-shaped such that said lower connecting portion can be inserted into a through hole of the other to-be-connected object.

6. A connector as claimed in claim 1, wherein said upper connecting portion includes a first contact portion that can be brought into contact with one surface of the other to-be-connected object, and a first spring portion that urges said first contact portion against the other to-be-connected object, and wherein said lower connecting portion includes a second contact portion that can be brought into contact with the other surface of the other to-be-connected object, and a second spring portion that urges said second contact portion against the other to-be-connected object.

7. A connector as claimed in claim 1, wherein said housing is formed with a first rotation-preventing surface that is brought into contact with one or the other surface of the other to-be-connected object, and transmits a rotational force of said housing, which is generated when the one end of the one to-be-connected object is obliquely inserted into the receiving space of said housing and the one to-be-connected object is caused to become substantially parallel to the other to-be-connected object, to the one or the other surface of the other to-be-connected object, to thereby prevent rotation of said housing.

8. A connector as claimed in claim 1, wherein said housing is formed with a second rotation-preventing surface that is brought into contact with a fixing member fixed to the other to-be-connected object, and transmits a rotational force of said housing, which is generated when the one end of the one to-be-connected object is obliquely inserted into the receiving space of said housing and the one to-be-connected object is caused to become substantially parallel to the other to-be-connected object, to said fixing member, to thereby prevent rotation of said housing.

* * * * *